US009841255B2

(12) United States Patent
Koskan et al.

(10) Patent No.: US 9,841,255 B2
(45) Date of Patent: Dec. 12, 2017

(54) INTELLIGENT HOLSTER SPACER

(71) Applicant: MOTOROLA SOLUTIONS, INC., Schaumburg, IL (US)

(72) Inventors: Patrick D. Koskan, Lake Worth, FL (US); Scott M. Alazraki, Davie, FL (US); Daniel A. Tealdi, Plantation, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 74 days.

(21) Appl. No.: 14/801,457

(22) Filed: Jul. 16, 2015

(65) Prior Publication Data

US 2017/0016696 A1 Jan. 19, 2017

(51) Int. Cl.
*F41C 33/04* (2006.01)
*F41C 33/02* (2006.01)

(52) U.S. Cl.
CPC ..... *F41C 33/04* (2013.01); *F41C 33/0209* (2013.01); *F41C 33/029* (2013.01); *F41C 33/041* (2013.01)

(58) Field of Classification Search
CPC ..... F41C 33/029; F41C 33/04
See application file for complete search history.

(56) References Cited

U.S. PATENT DOCUMENTS 5,414,596 A 5/1995 Eaton et al.
5,449,103 A 9/1995 Tilley
5,479,149 A 12/1995 Pike
5,598,958 A * 2/1997 Ryan, III ..... F41C 33/045 224/192
5,828,301 A * 10/1998 Sanchez ..... F41C 33/029 224/244
6,588,640 B1 * 7/2003 Rogers ..... A45F 5/021 224/192
6,616,020 B1 * 9/2003 Spielberger ..... F41C 33/0245 224/183

(Continued)

FOREIGN PATENT DOCUMENTS

WO WO 02057701 A9 * 9/2003 ..... F41C 33/0209
WO 2006075970 7/2006

(Continued)

OTHER PUBLICATIONS

PCT/US2016/041579 International Search Report and Written Opinion of the International Searching Authority dated Sep. 28, 2016 (12 pages).

(Continued)

*Primary Examiner* — Justin Larson
(74) *Attorney, Agent, or Firm* — Michael Best & Friedrich LLP

(57) ABSTRACT

A holster spacer adaptable for use within a holster assembly including a wearable component and a separable holster supported by the wearable component. The holster spacer includes a wearable component-facing surface, a holster-facing surface opposite the wearable component-facing surface, a mounting interface, an internal cavity provided between the wearable component-facing surface and the holster-facing surface, and a sensor operable to detect a parameter relating to an implement positionable within the holster.

24 Claims, 42 Drawing Sheets

(56) References Cited

U.S. PATENT DOCUMENTS

| | | | | |
|---|---|---|---|---|
| 7,950,554 | B2 * | 5/2011 | Hoffner | A45F 5/02 224/222 |
| 7,971,762 | B2 * | 7/2011 | Clifton, Jr. | A45F 5/02 224/197 |
| 8,469,245 | B2 * | 6/2013 | Gregory | F41C 33/045 224/198 |
| 9,086,254 | B1 * | 7/2015 | Plappert | F41C 33/041 |
| 9,336,675 | B2 * | 5/2016 | Miller | G08B 27/001 |
| 2008/0061991 | A1 * | 3/2008 | Urban | F41C 33/0209 340/573.1 |
| 2011/0181238 | A1 | 7/2011 | Soar | |
| 2014/0162584 | A1 * | 6/2014 | Cope | F41C 33/0227 455/404.1 |
| 2015/0254968 | A1 * | 9/2015 | Sanders | F41C 33/029 340/539.13 |
| 2015/0369559 | A1 * | 12/2015 | Del Rosario | F41C 33/029 340/686.4 |
| 2016/0054080 | A1 * | 2/2016 | Haimi | F41A 17/06 42/70.06 |
| 2016/0076852 | A1 * | 3/2016 | Liu | F41C 33/0209 224/587 |
| 2016/0116253 | A1 * | 4/2016 | Moon | F41C 33/029 224/244 |
| 2016/0165192 | A1 * | 6/2016 | Saatchi | H04N 5/772 386/227 |
| 2016/0190859 | A1 * | 6/2016 | Blum | H02J 7/025 348/372 |

FOREIGN PATENT DOCUMENTS

| | | | | |
|---|---|---|---|---|
| WO | 2013191648 | | 12/2013 | |
| WO | WO 2015156921 | A1 * | 10/2015 | F41C 33/029 |
| WO | WO 2016100360 | A1 * | 6/2016 | F41A 17/06 |
| WO | WO 2016109577 | A1 * | 7/2016 | H02J 7/025 |
| WO | WO 2016134336 | A1 * | 8/2016 | F41A 33/00 |

OTHER PUBLICATIONS

Blackhawk! "Holster Spacer Kit—Tactical/Duty" http://www.blackhawk.com/Products/Holsters-Duty-Gear/Holsters/Accessories/Platforms/Carbon-Fiber-Holster-Spacer-Kit-Tactical-Duty.aspx (accessed Jul. 15, 2015).

The Safariland Group "T-Spacer Hardware Kit" http://www.safariland.com/spacer-kits/t-spacer-hardware-kit-23109.html (accessed Jul. 15, 2015).

* cited by examiner

INTELLIGENT HOLSTER SPACER

BACKGROUND OF THE INVENTION

There are numerous different types of implements (for example, flashlights, weapons, tools, accessories, and the like) that are commonly carried or worn on an individual's person for convenient access, typically by a holster supported at the individual's waist by a belt or another type of body-engaging strap, harness, etc. As individuals strive to optimize control and utilization of body worn equipment, (for example weapons used by law enforcement), there is an increased desire for real-time notifications, data collection, monitoring, and control. It will be appreciated that solutions to provide such additional functionality require customizability and flexibility due to the wide range of different sizes and shapes of tools and weapons and their corresponding holsters.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
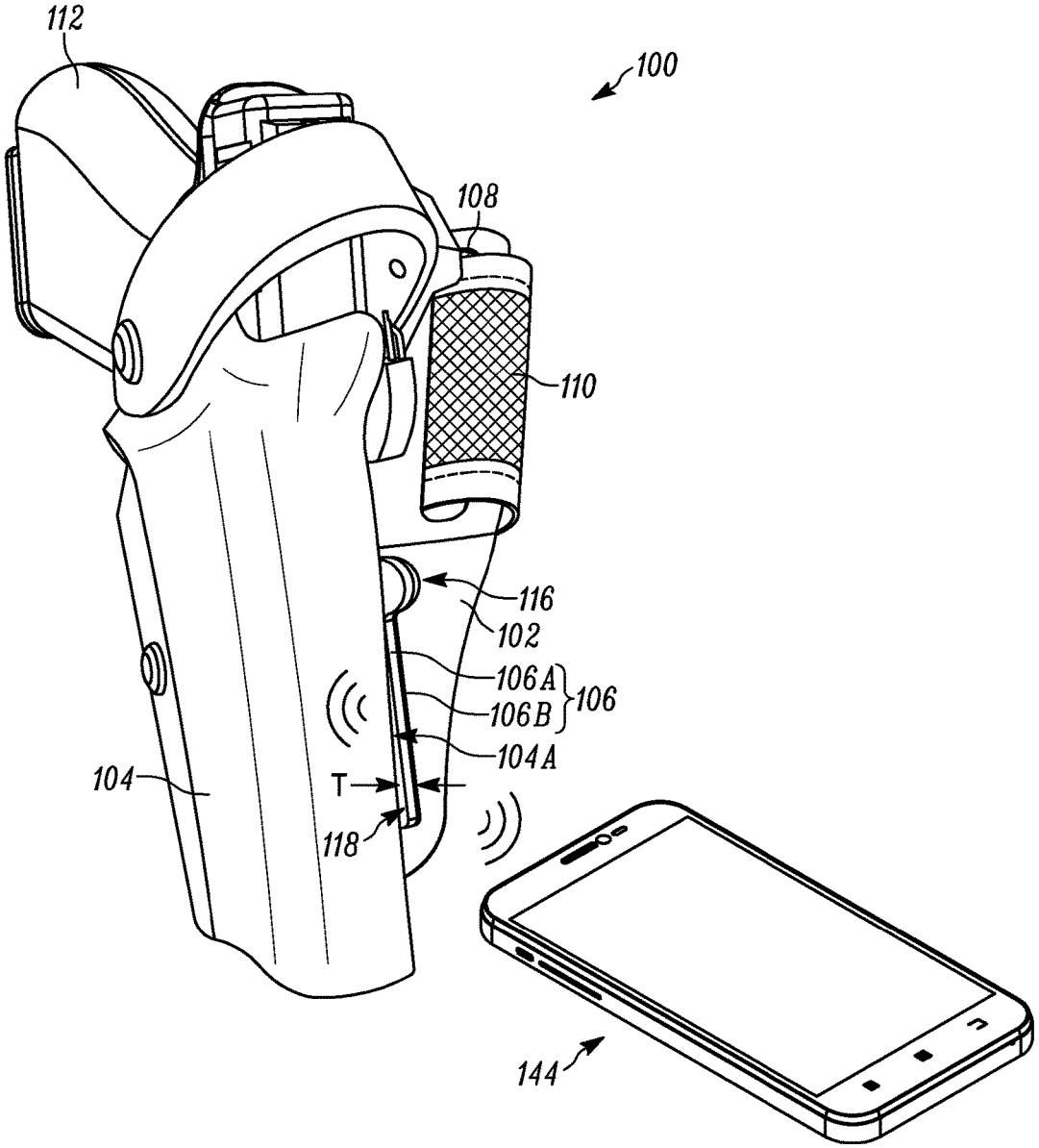
FIG. 1 is a perspective view of a holster assembly including a holster spacer in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

A holster spacer adaptable for use within a holster assembly including a wearable component and a separable holster supported by the wearable component. The holster spacer includes a wearable component-facing surface, a holster-facing surface opposite the wearable component-facing surface, a mounting interface, an internal cavity provided between the wearable component-facing surface and the holster-facing surface, and a sensor operable to detect a parameter relating to an implement positionable within the holster.

Figure 3:
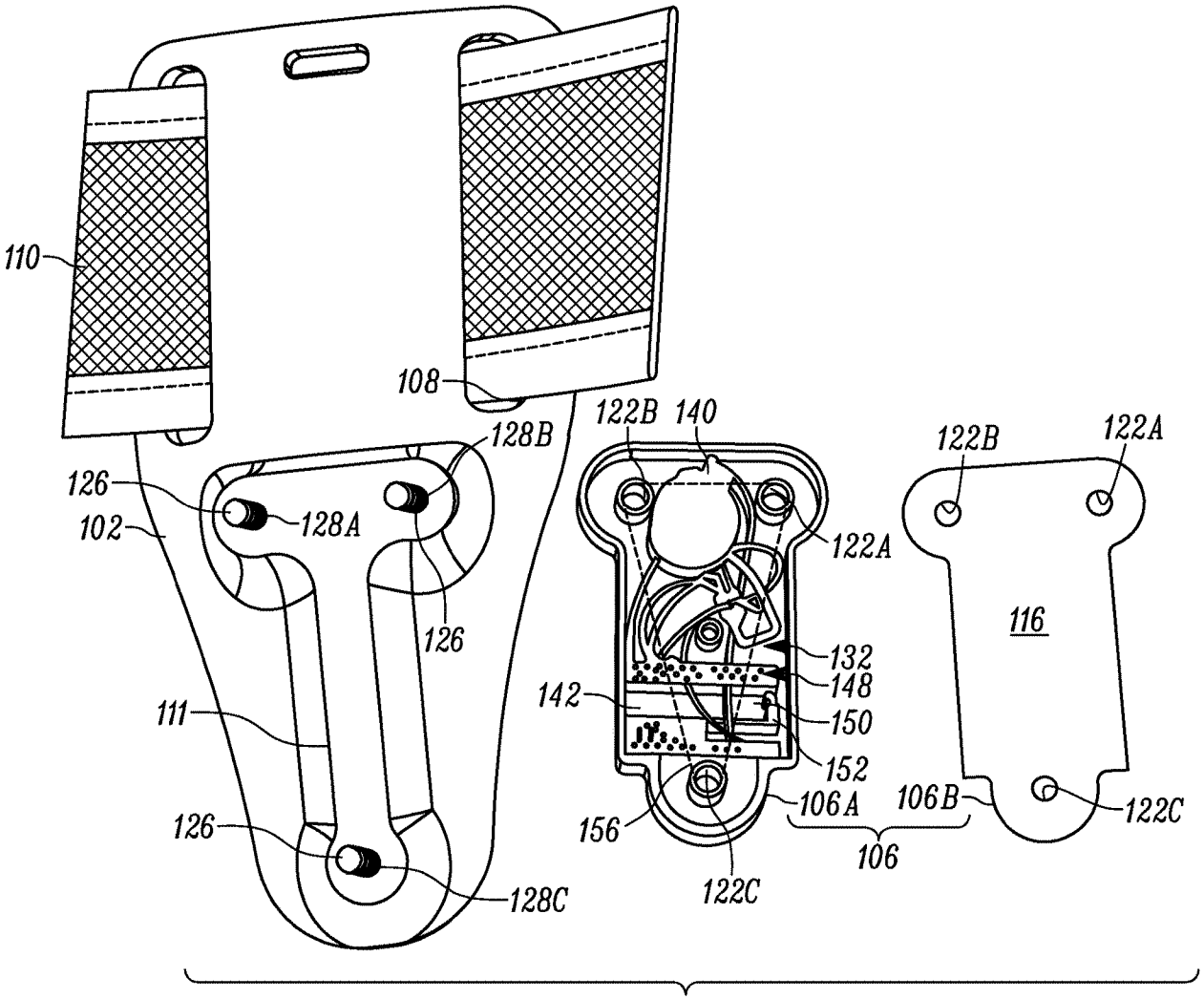
FIG. 3 is an exploded assembly view of the holster spacer of FIGS. 1 and 2, removed from a belt loop adapter.
Figure 4:
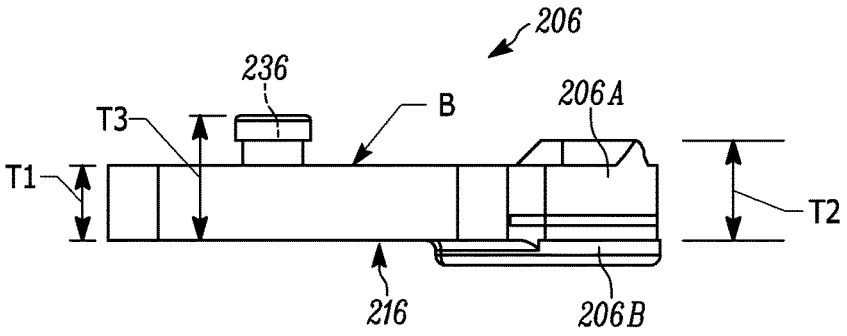
FIG. 4 is a top view of a holster spacer in accordance with some embodiments.
Figure 5:
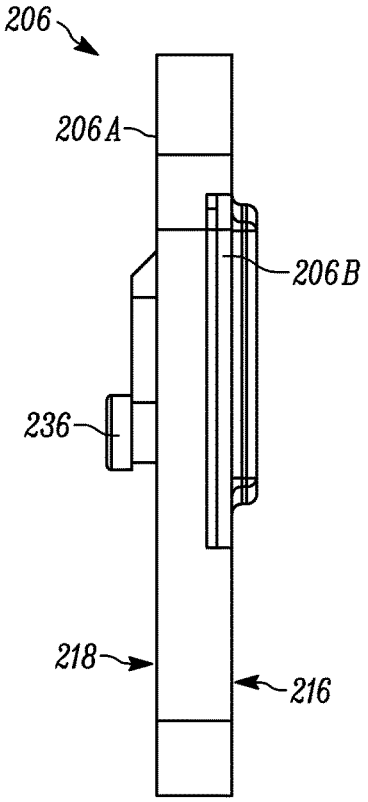
FIG. 5 is a left side view of the holster spacer of FIG. 4.
Figure 6:
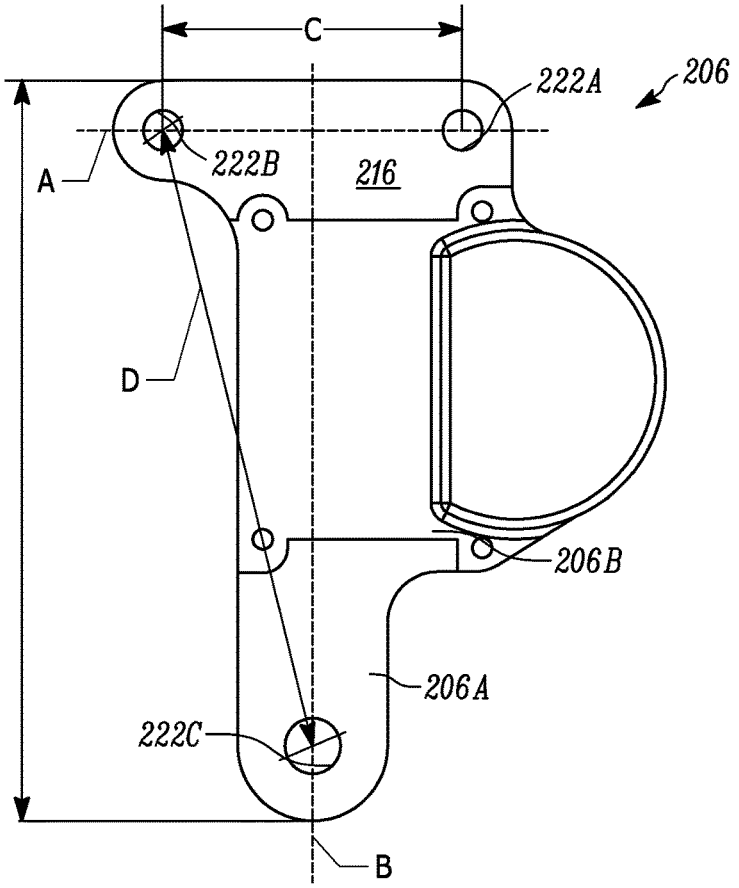
FIG. 6 is a front view of the holster spacer of FIG. 4.
Figure 8:
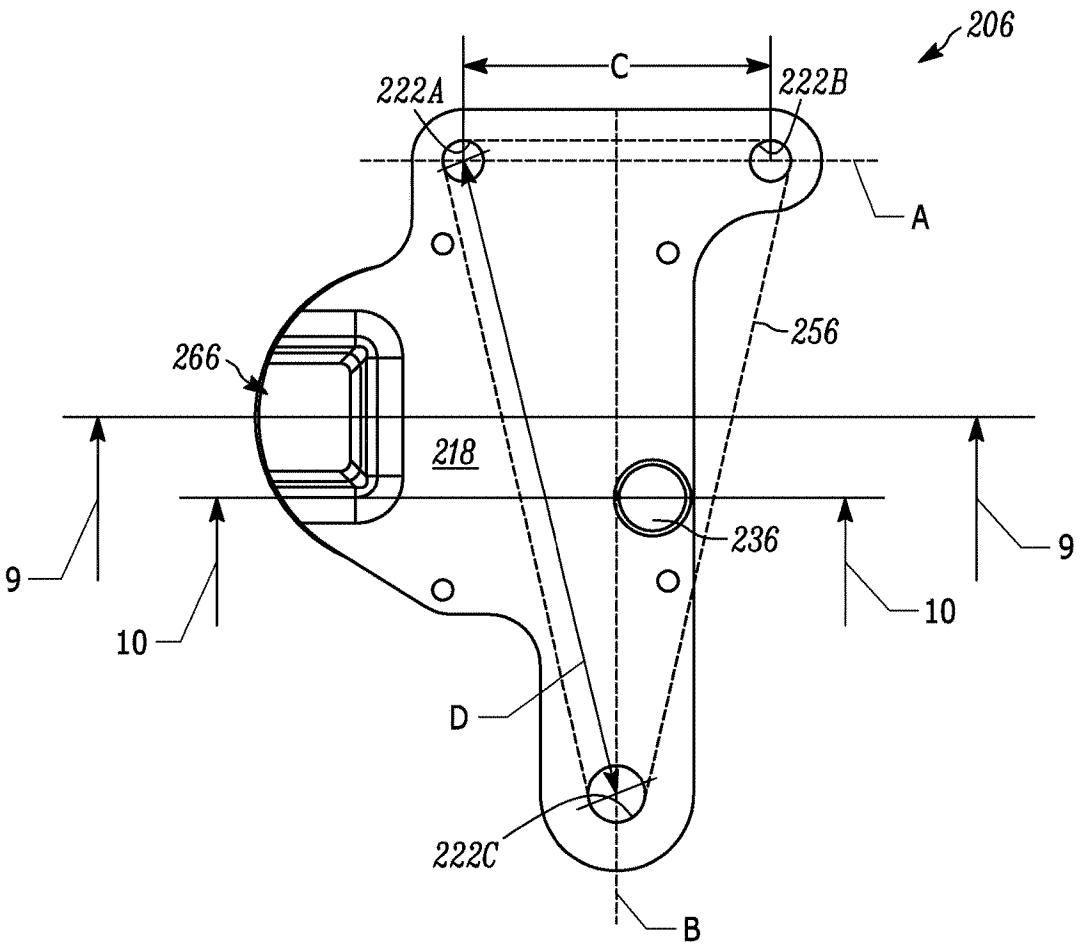
FIG. 8 is a rear view of the holster spacer of FIG. 4.
Figure 7:
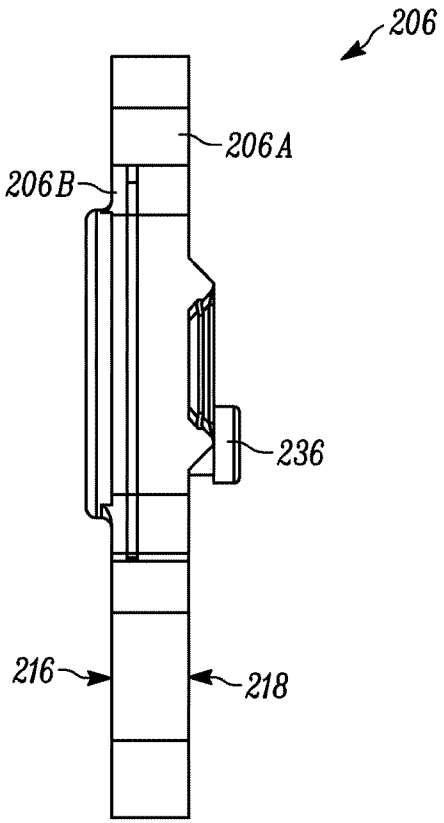
FIG. 7 is a right side view of the holster spacer of FIG. 4.

FIG. 1 illustrates a holster assembly 100 including a wearable component 102, a holster 104 removably supported by the wearable component 102, and a holster spacer 106 positioned at least partially between the wearable component 102 and the holster 104. As shown, the wearable component 102 is a belt adapter having slits 108 for passage of a belt 110 or similar strap, harness, etc. However, the wearable component 102 can take a variety of different forms for coupling directly or indirectly (e.g., via a utility belt, a sling, a utility vest, a shirt or jacket epaulet, headgear, a leg shroud, or a strap) to a human body, and in some constructions, to other objects such as a vehicle interior or exterior. As shown in FIG. 3, the wearable component 102 includes a raised surface portion defining a holster mounting platform 111. The holster mounting platform 111, in the illustrative embodiment, has a T-shape. It will be appreciated that the holster mounting platform 111 can alternatively have any appropriate shape.

The holster 104 is illustrated as a gun holster that includes a receiving area shaped to securely receive a pistol 112. However, the holster 104 can take a variety of different forms corresponding to a variety of different implements, including alternate types or styles of weapons and tools. As a non-limiting example, the holster 104 can be provided with a receiving area shaped and sized to secure: a conducted electrical weapon (CEW or "stun gun"), a flashlight, an electronic device, a communication device, a camera, handcuffs, an ammunition magazine, a pepper spray canister, or a knife. In addition, it should be noted that the illustrated holster design may take virtually any known form, including a pouch, cradle, carry case, etc. that may partially or fully enclose an implement while not in use.

The holster spacer 106 includes a wearable component-facing surface 116 and a holster-facing surface 118 opposite the wearable component-facing surface 116. The wearable component-facing surface 116 and the holster-facing surface 118 can be flat, angled, or contoured to any desired shape. With some holster designs, the holster spacer 106 may be used between multiple layers of a holster. In some constructions, the holster spacer 106 can be used in addition to or as a direct replacement for a conventional passive spacer element commonly used to position the holster 104 at an increased distance from the wearable component 102. For instance, the holster spacer 106 includes a mounting interface provided in the illustrated construction of FIGS. 2 and 3 by a plurality of apertures including a first aperture 122A, a second aperture 122B, and a third aperture 122C. The holster spacer 106 defines a thickness T to maintain a spacing distance between the holster mounting platform 111 (FIG. 3) of the wearable component 102 and a surface 104A of the holster 104 configured to face towards the wearable component 102 and the wearer when worn. In general, the holster spacer 106 may increase the spacing distance of the holster 104 away from the wearer to a more comfortable or convenient distance. A variety of the holster spacers 106 may be provided with different thicknesses T, for selection by the end user.

Figure 2:
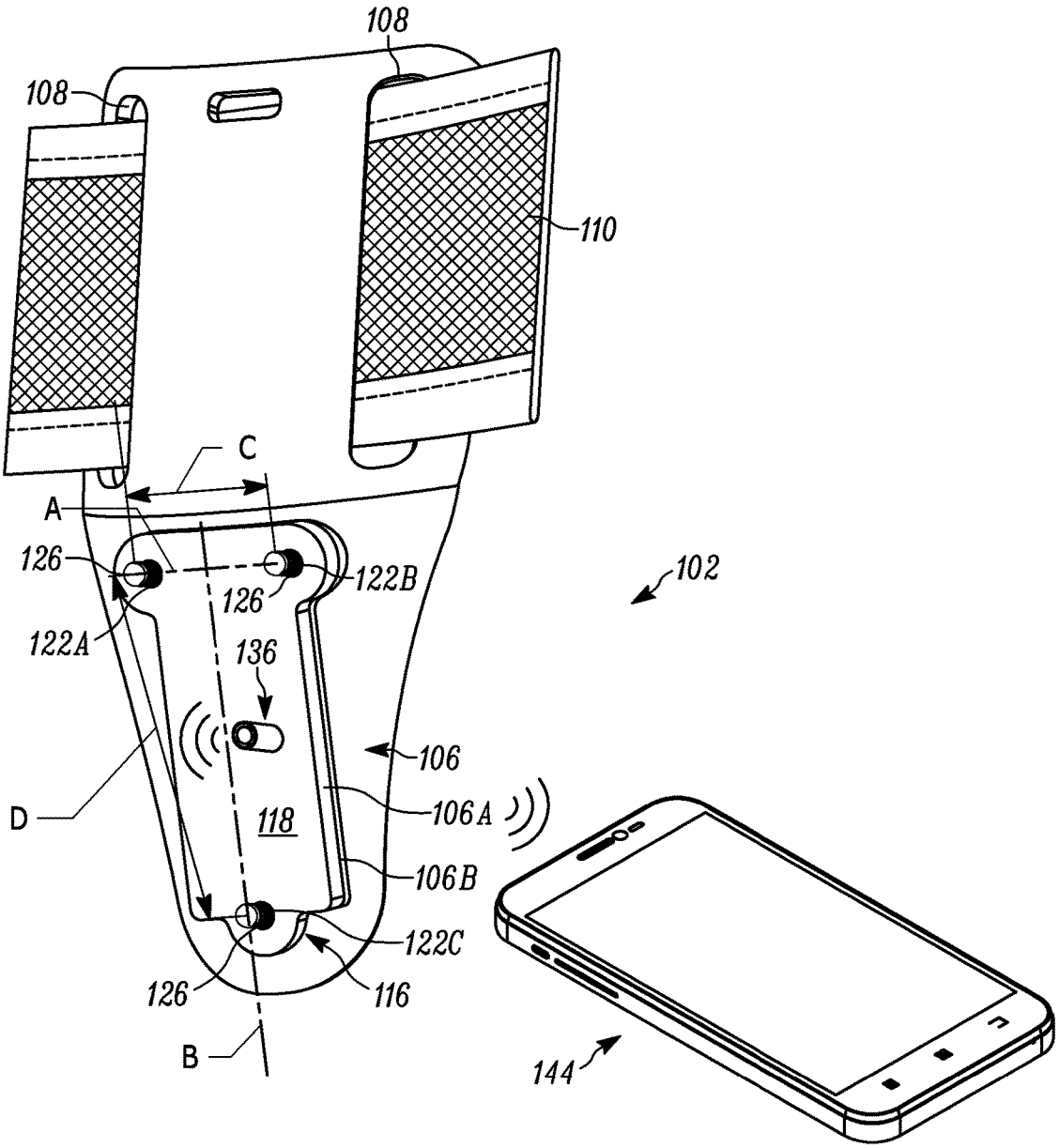
FIG. 2 is a perspective view of the holster assembly of FIG. 1, with the holster removed to further illustrate the holster spacer and a mounting interface thereof.

The first and second apertures 122A, 122B are provided adjacent a first end (e.g., an upper end adjacent the slits 108) of the holster spacer 106, while the third aperture 122C is provided adjacent a second end (e.g., a bottom end remote from the slits 108) of the holster spacer 106. The first and second apertures 122A, 122B are spaced apart from each other along a first axis A, and the third aperture 122C is equally spaced from each of the first and second apertures 122A, 122B and positioned along a second axis B that bisects the first axis A. A spacing distance C between the first and second apertures 122A, 122B along the first spacing axis A is less than a spacing distance D from the third aperture 122C to the first and second apertures 122A, 122B. As shown in FIGS. 1 through 3, the holster spacer 106 can include multiple housing portions 106A, 106B, which can be provided as shell halves or as a main housing and cover. The apertures 122A, 122B, 122C of the mounting interface can be provided through both of the housing portions 106A, 106B. As shown in FIGS. 2 and 3, a fastener 126 is provided for each of the first, second, and third apertures 122A, 122B, 122C. As shown, each fastener 126 is a threaded fastener (i.e., screw, bolt, etc.) that extends through the wearable component 102 and the holster spacer 106 to engage the holster 104, although one or more of the fasteners 126 may take other forms in other constructions. While not limiting, the diameter of each of the first, second, and third apertures 122A, 122B, 122C can be between 0.154 in. and 0.221 in., such that they are configured to receive fasteners 126 such as #6, #8, or #10 machine screws, or metric counterparts. The wearable component 102 defines a mounting interface that matches that of the holster spacer 106. In other words, the wearable component 102 includes first, second, and third apertures 128A, 128B, 128C having the same spacing relationship as described above. Although not illustrated, an interior-facing side of the holster 104 also has a matching mounting interface. In other constructions, one or more fasteners securing the holster spacer 106 between the wearable component 102 and the holster 104 can include any one or more of: hook-and-loop fabric or strips, permanent or removable adhesive, and one or more magnets.

The holster spacer 106 further includes an internal cavity 132 provided between the wearable component-facing surface 116 and the holster-facing surface 118. The holster spacer 106 includes a sensor 136 operable to detect the implement (e.g., the pistol 112 as illustrated) that is received by the holster 104. For example, the sensor 136 can be a magnetic sensor. As shown, although not required in some constructions, the sensor 136 can be formed to project perpendicularly from the holster-facing surface 118. However, in this design, the projected length of the sensor 136 does not increase the spacing distance between the wearable component 102 and the holster (provided by the thickness T) since the sensor 136 is received by a recess in the holster 104. The recess can be a pocket, aperture, cutout, etc., which allows a tighter positional relationship between the pistol 112 and the sensor 136. Electronic circuitry, including a power source 140 and a processor 142 in communication with the sensor 136, is provided within the internal cavity 132. Some or all of the electronic circuitry can be provided on a printed circuit board assembly 148. As shown, the power source 140 may take the form of a primary battery, although other constructions provide the power source 140 as any one or more of: a primary battery, a rechargeable battery, a supercapacitor, and an energy harvesting circuit. During operation, the processor 142 is in communication with the sensor 136 to receive an output of the sensor 136. The output of the sensor 136 can be communicated via one or more wires or wirelessly to the processor 142 for further transmission via a transceiver and/or storage within an on-board memory operable to store code instructions and data. The transceiver and memory may be provided as part of a communication module 150 on the printed circuit board assembly 148. The communication module 150 can be provided as part of a daughter board on the printed circuit board assembly 148 with a transceiver such as a Bluetooth transceiver operable to communicate via the Bluetooth communication protocol (including optionally Bluetooth Smart, a low energy variant thereof, which may be referred to as Bluetooth LE). The communication module 150 can be an integrated circuit or module including the transceiver, a memory, a processor. An antenna 152 is positioned on the printed circuit board assembly 148 on or adjacent to the communication module. In other constructions, the transceiver is operable to communicate via any one of the following communication protocols: wireless local area network (WLAN or "WiFi"), near field communication (NFC), inductive communication, personal area network (PAN), wide area network (WAN), and body area network (BAN). In some constructions, the electronic circuitry within the holster spacer 106 includes wireless charging circuit operable to recharge one or more portable electronic items carried by the attached holster 104 or conversely have its own power source 140 be charged by an external wireless charging system.

As shown in FIGS. 1 and 2, a wireless signal from the holster spacer 106 (in particular, from the transceiver therein) can be sent to a remote device 144. As illustrated, the remote device 144 can be a paired personal electronic device such as a smart phone carried locally with the individual wearing the holster assembly 100. In such constructions, the remote device may run an application specifically designed to monitor the status of the pistol 112 or other holstered implement via one or more sensed parameters sensed by the holster spacer 106. If so enabled, the remote device 144 can communicate further to a remote computer, server, or database acting as a monitoring and/or control center. Such communication may be made in one-way or two-way fashion via an available land mobile network, cellular network or internet connection, for example. The remote device 144 may perform one or more of the following actions upon receiving a status change from the sensor 136: launch an application, update an application, trigger an alert, trigger an alarm, trigger a notification, update a log, place a service request.

It has been described that the sensor within the holster spacer 106 is operable to detect the pistol 112, or other holstered implement, which will be understood as the ability for the sensor to confirm presence, absence, and/or proximity of the pistol 112. However, depending upon the particular holstered implement and the desired implementation, the holster spacer 106 can alternately or additionally include one or more other sensors detecting any one or more of the following states or parameters of the holstered implement: health, battery level, identity, authorization, temperature, history, trend, wear, use, weight/mass, and orientation. As a non-limiting list of examples, the illustrated sensor or other sensor(s) of the holster spacer 106 can include any one or more of: a magnetic sensor, a pressure sensor, an optical sensor, a mechanical sensor, a sonic sensor, an inertial sensor, an inductive sensor, a capacitive sensor, a resistive sensor, an electromagnetic sensor, a thermal sensor, a chemical sensor, and a biological sensor. In one example, for use with the pistol 112 or other firearm, a chemical sensor can be provided that is operable to detect gunpowder for identifying whether the pistol 112 has just been fired. Such a chemical sensor can be active on an ongoing basis, or can be activated upon the sensor 136 detecting removal of the pistol 112 from the holster 104. In another example, the holster spacer 106 includes at least one sensor operable to detect an item state within a container, for example an amount of pepper spray, a charge level of a conducted electrical weapon, or a number of rounds in an ammunition magazine.

As shown in FIG. 3 by a set of dashed lines, an imaginary envelope area 156 is defined by outside tangent lines connecting the first, second, and third apertures 122A, 122B, 122C. In other constructions having different mounting interfaces, the imaginary envelope area 156 is generally defined as the area immediately encompassing the mounting interface, such as by straight connecting lines which do not meander between structures forming the mounting interface, and which do not intersect the structures forming the mounting interface. In the illustrated construction, at least a portion of each of the following are positioned within the imaginary envelope area 156: the sensor 136, the power source 140, and the printed circuit board assembly 148. However, in some constructions, one or all of the above-listed elements may be positioned partially or entirely outside of the imaginary envelope area 156.

FIGS. 4 through 13 illustrate a holster spacer 206 according to another embodiment. Although not shown, it will be understood that the holster spacer 206 may be provided between a wearable component and a holster as part of a holster assembly similar to the holster assembly 100 as shown in FIG. 1. It is also noted that reference numbers for similar features and elements are kept in order, similar to those of FIGS. 1 through 3, but incremented by 100 (i.e., 236 designates a sensor, whereas 136 designates the sensor in the earlier embodiment). The description of the holster spacer 206 of FIGS. 4 through 13 focuses primarily on the features that are unique from the holster spacer 106 of FIGS. 1 through 3 with the understanding that the holster spacer 206 can include any and all of the features disclosed above with reference to the holster spacer 106 of FIGS. 1 through 3, except where expressly prohibited.

The holster spacer 206 includes a wearable component-facing surface 216 and an opposite holster-facing surface 218. Like the holster spacer 106 of FIGS. 1 through 3, the holster spacer 206 also includes a mounting interface including first, second, and third apertures 222A, 222B, 222C. In fact, the layout of the first, second, and third apertures 222A, 222B, 222C along the first and second axes A, B may be identical to that shown and described with respect to FIGS. 1 through 3 such that the holster spacers 106, 206 are interchangeable. In other words, the spacing distances C, D and aperture diameters may be similar or identical.

Unlike the substantially uniform thickness T of the spacer 106 of FIGS. 1 through 3, the spacer 206 includes a first area having a first thickness T1 and a second area having second thickness T2, greater than the first thickness T1. The sensor 236 of the holster spacer 206 projects outwardly from the holster-facing surface 218 in the area of the first thickness T1 to define a third thickness T3. However, the sensor 236 can be received by a recess in the mating holster such that the effective spacing distance provided by the holster spacer 206 is equal to T1. All or a majority of the first area falls within the imaginary envelope area 256, while all or a majority of the second area falls outside of the imaginary envelope area 256.

Figure 9:
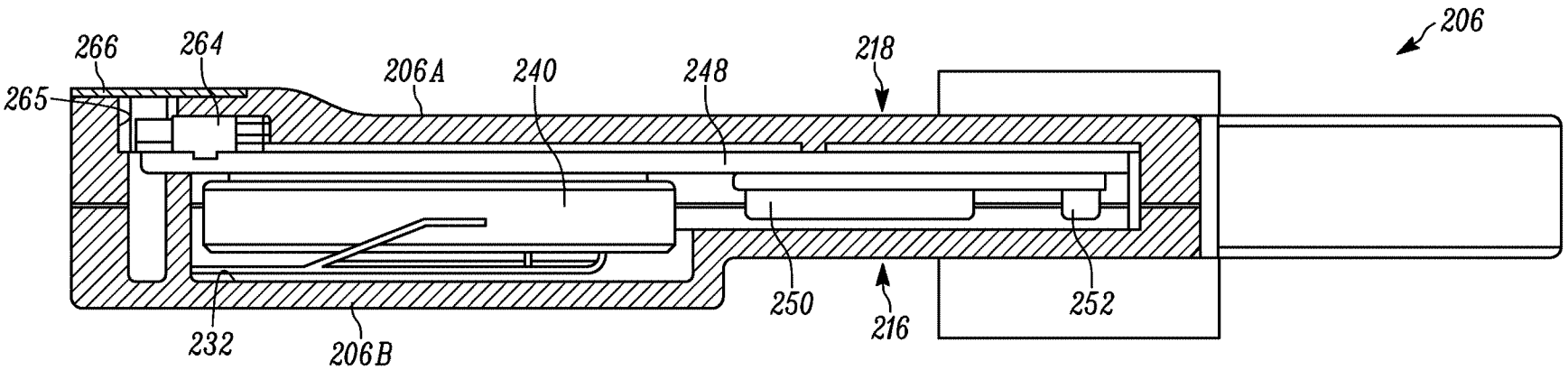
FIG. 9 is a first cross-section view of the holster spacer of FIG. 4.

The cross-section of FIG. 9 illustrates a switch 264 located on the printed circuit board assembly 248 and operable to selectively establish and break power supply to the electronic circuitry from the power source 240. The switch 264 is shown in further detail in FIG. 13. The switch 264 can be a slide switch or another suitable type of switch. The switch 264 is selectively accessible from the outside of the holster spacer 206 through an aperture 265. The aperture 265 can be selectively closed by a removable cover 266 to prevent access to the switch 264. The cover 266 may be constructed of a material at least partially transparent or translucent so as to permit passage of light. An indicator light such as a light emitting diode (not shown) can be positioned on the printed circuit board assembly 248 adjacent the switch 264 and operable to illuminate when the switch 264 is in an ON position. The indicator light may be selectively illuminated, or may change to a second color, when the communication module 250 is paired with a remote device as a means of confirmation to the user. The imaginary prismatic volume surrounding the antenna 252 on the printed circuit board assembly 248 represents an isolation area for avoiding interference of other components with the antenna 252.

Figure 10:
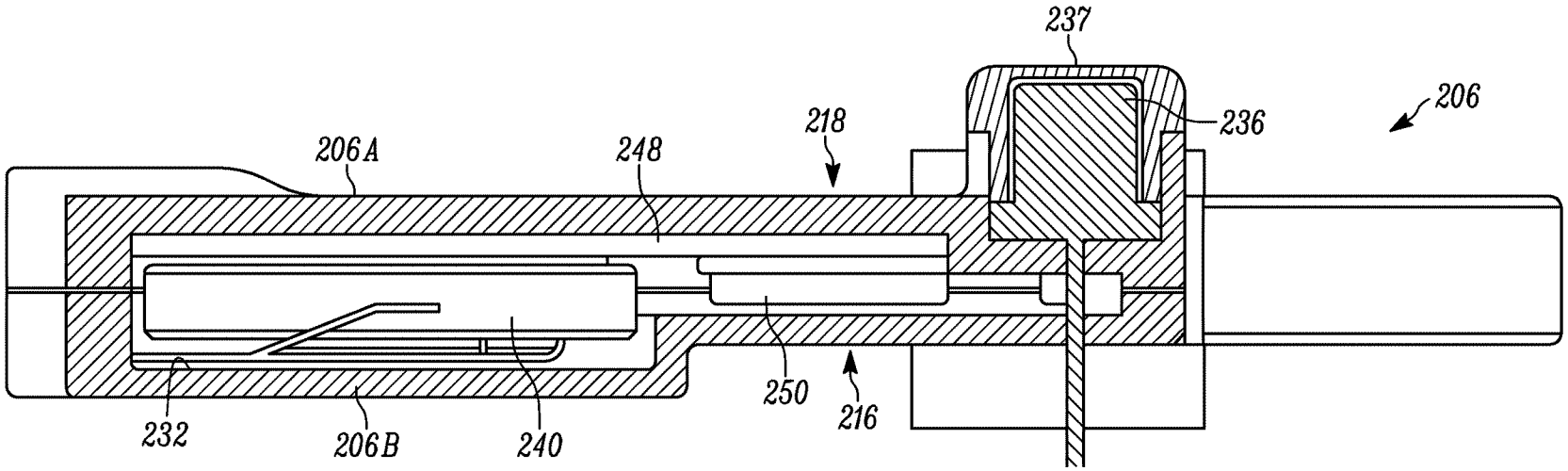
FIG. 10 is a second cross-section view of the holster spacer of FIG. 4.
Figure 11:
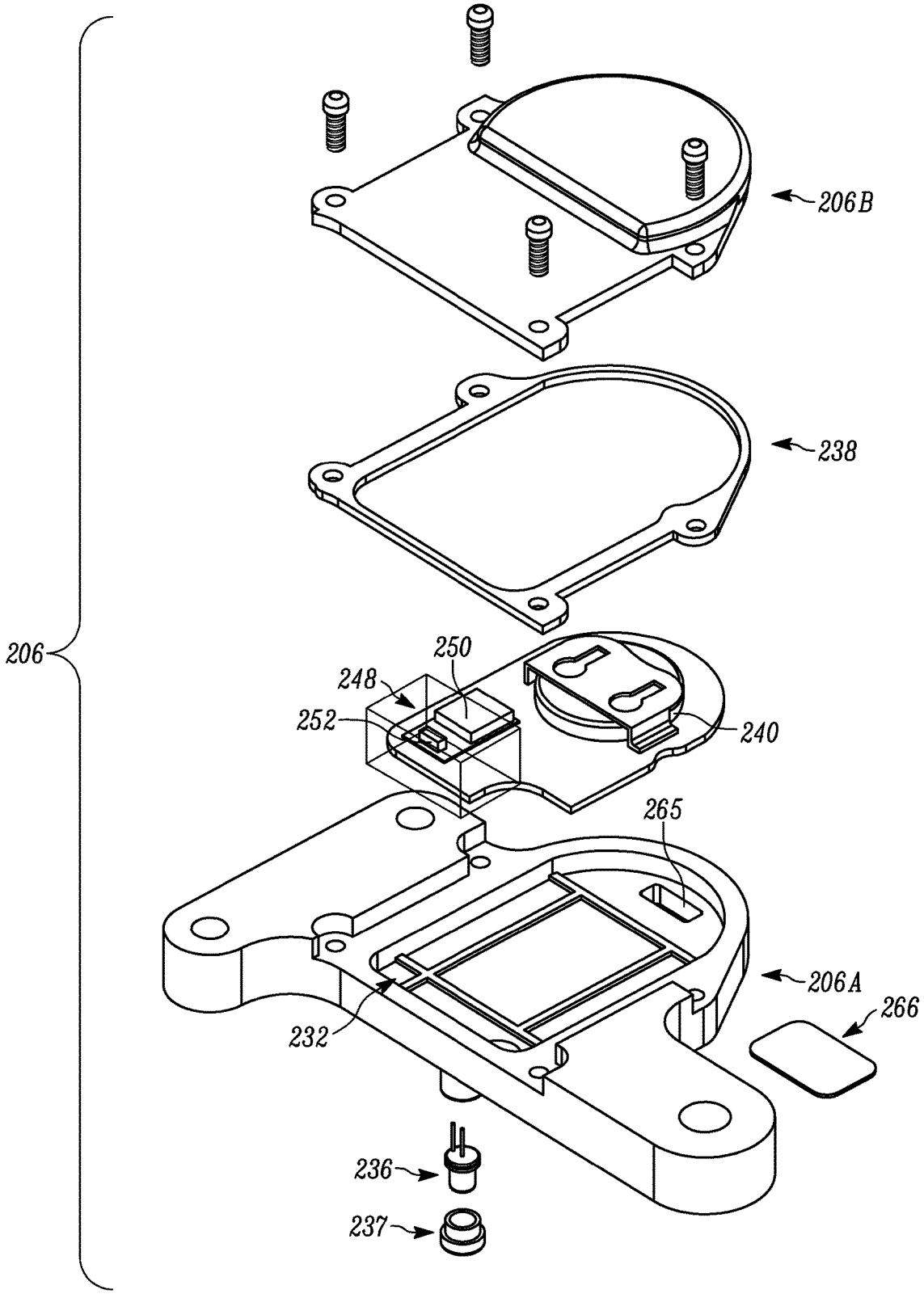
FIG. 11 is an exploded assembly view of the holster spacer of FIG. 4.
Figure 12:
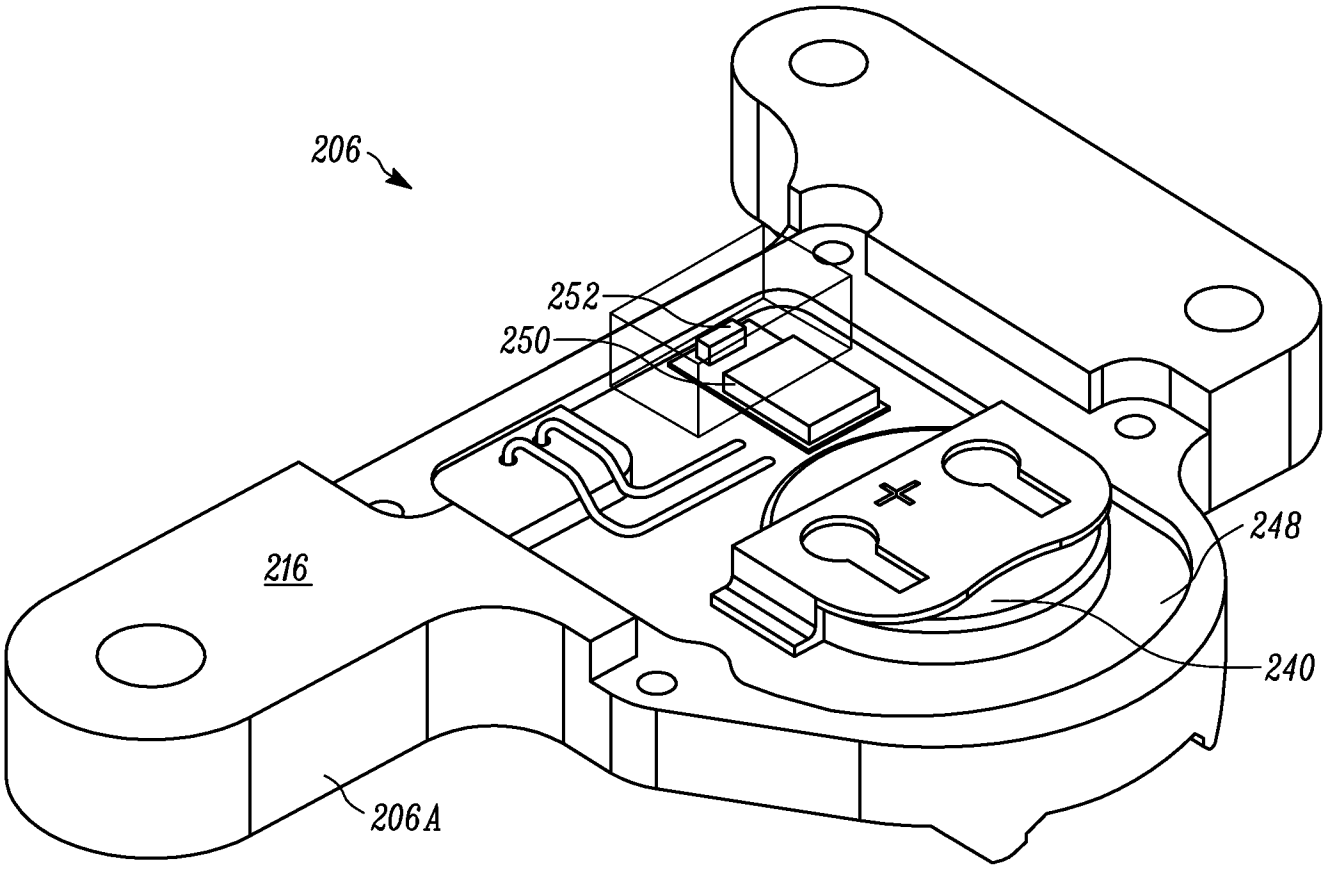
FIG. 12 is a perspective view of the internals of the holster spacer of FIG. 4.
Figure 13:
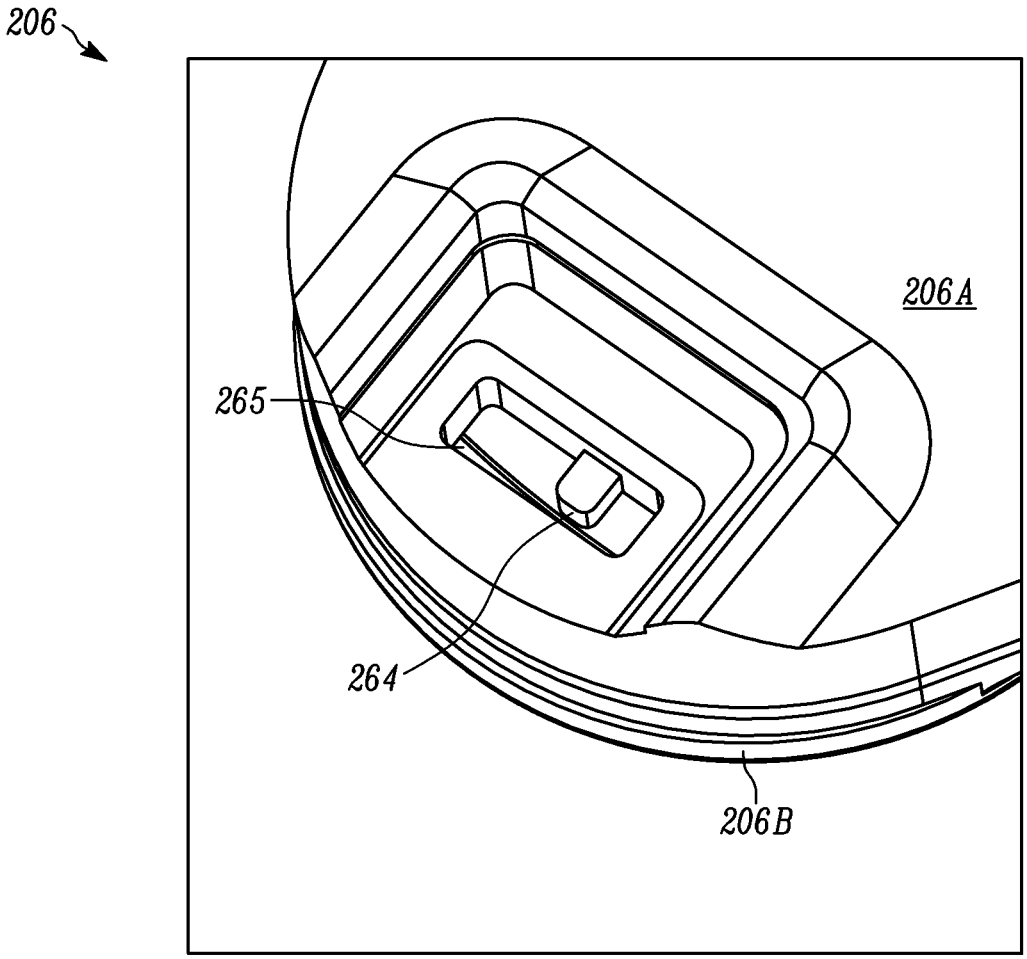
FIG. 13 is a of the holster spacer of FIG. 4, with a switch cover removed.
Figure 14:
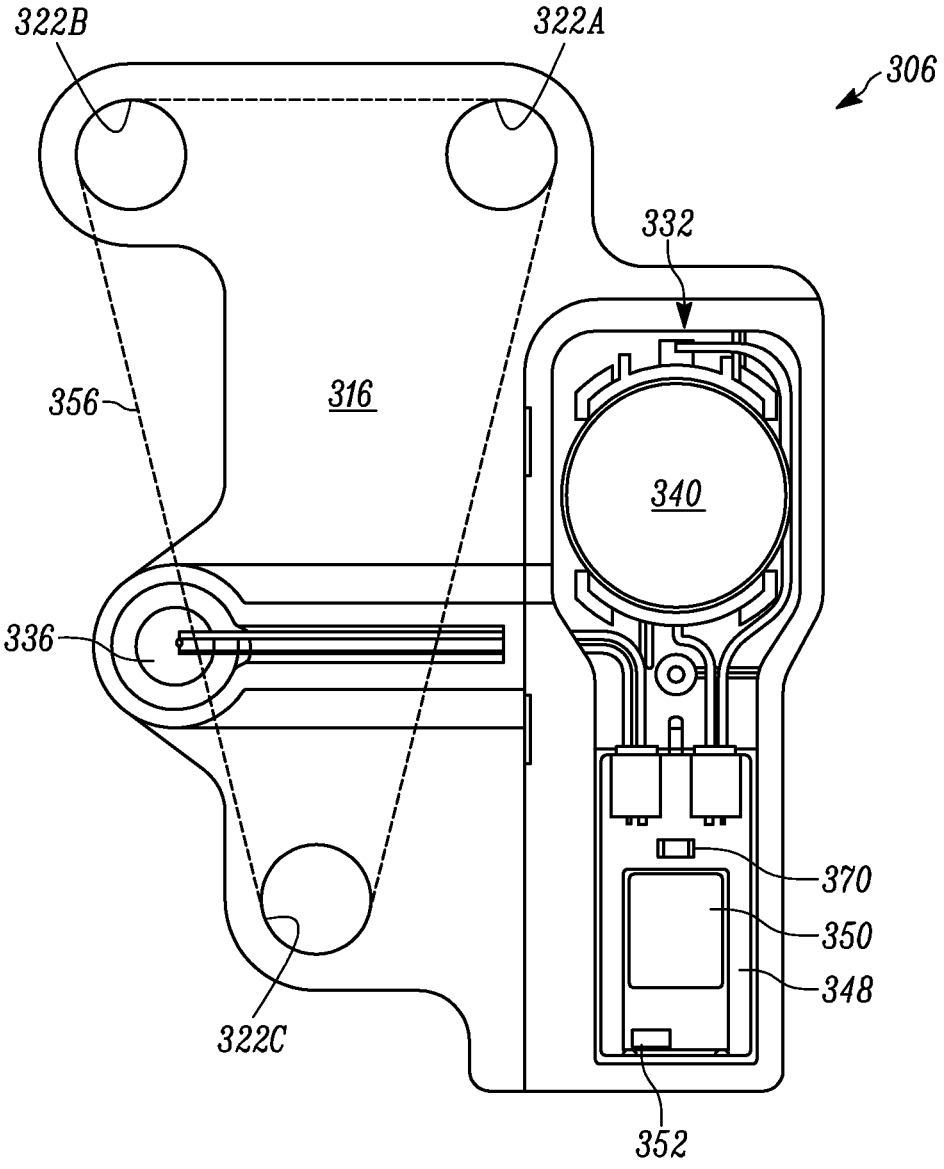
FIG. 14 is a rear view of a holster spacer in accordance with some embodiments, having a cover removed to illustrate an internal cavity containing a sensor and associated electronic circuitry.
Figure 15:
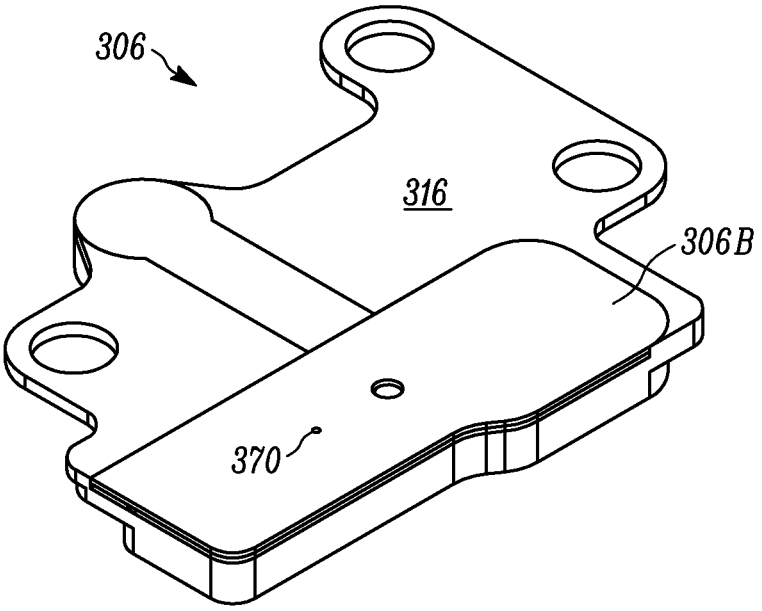
FIG. 15 is a first perspective view of the holster spacer of FIG. 14.
Figure 16:
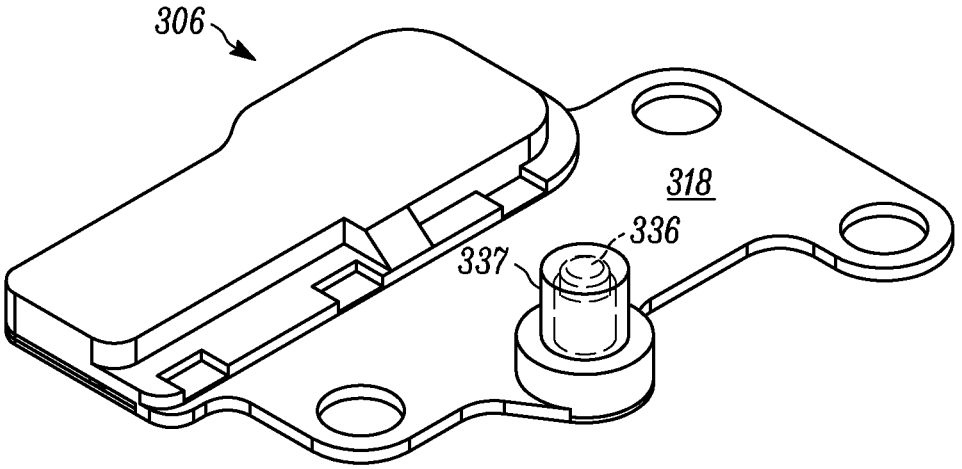
FIG. 16 is a second perspective view of the holster spacer of FIG. 14.

The cross-section of FIG. 10 is taken directly through the sensor 236 and illustrates a sensor sleeve 237 secured to the housing portion 206A that partially or fully covers the sensor 236. The sensor sleeve 237 may be interchangeable with other similar sensor sleeves of alternate length for use with the same housing portion 206A as a means for varying or adjusting the sensor depth perpendicular to the holster-facing surface 218. The sensor sleeve 237 is further illustrated in the exploded assembly view of FIG. 11, which also shows that the connection between the housing portions 206A, 206B may be made with one or more fasteners. A gasket or adhesive 238 may be positioned between the housing portions 206A, 206B for mating and/or sealing. FIG. 12 illustrates wires extended from the sensor 236 on one side of the printed circuit board assembly 248 to an opposite side of the printed circuit board assembly 248 where they are electrically and mechanically coupled thereto.

FIGS. 14 through 30 respectively illustrate a holster spacer 306 and a holster assembly 300 including the holster spacer 306, according to another embodiment. The holster spacer 306 is provided between the wearable component 102 and a holster 304 shaped and sized for a different type of pistol 312 compared to the holster 104 and the pistol 112 of FIG. 1. Although no one particular type of wearable component is required, it should be noted that the wearable component 102 may be somewhat universal for use with a variety of holster spacers and holsters having a common mounting interface. Reference numbers for similar features and elements are kept in order, similar to those of FIGS. 1 through 3, but incremented by 200. The description of the holster spacer 306 of FIGS. 14 through 30 focuses primarily on the features that are unique from the holster spacers 106, 206 of FIGS. 1 through 3 and FIGS. 4 through 13, respectively, with the understanding that the holster spacer 306 can include any and all of the features disclosed above with reference to the holster spacers 106, 206, except where expressly prohibited.

The holster spacer 306 includes a sensor 336 that is located separate and spaced away from the internal cavity 332 that houses the electronic circuitry. Thus, the sensor location and type of sensor is flexible and independent of the electronic circuitry. As shown, the sensor 336 is positioned at least partially outside of the imaginary envelope area 356, and in some cases may be positioned entirely outside of the imaginary envelope area 356. However, a portion of the illustrated sensor 336 is also positioned within the imaginary envelope area 356. The electronic circuitry is positioned partially or entirely outside of the imaginary envelope area 356. For example, the power source 340, and the printed circuit board assembly 348 (having the processor 342 and the transceiver 350 thereon) are located entirely outside of the imaginary envelope area 356. In some constructions, the holster spacer 306 may provide an adjustable sensor location by providing multiple sensor mounts (e.g., pockets or recesses) or by providing an infinitely adjustable (e.g., sliding) mounting interface that allows the sensor 336 to be adjusted as desired and locked into position. The sensor 336 position may be adjustable in a plane parallel to the holster-facing surface 318, and may also be adjustable for sensor depth in a direction perpendicular to the holster-facing surface 318 such that the relative distance from the sensor 336 to the pistol 312 can be adjusted.

Figure 23:
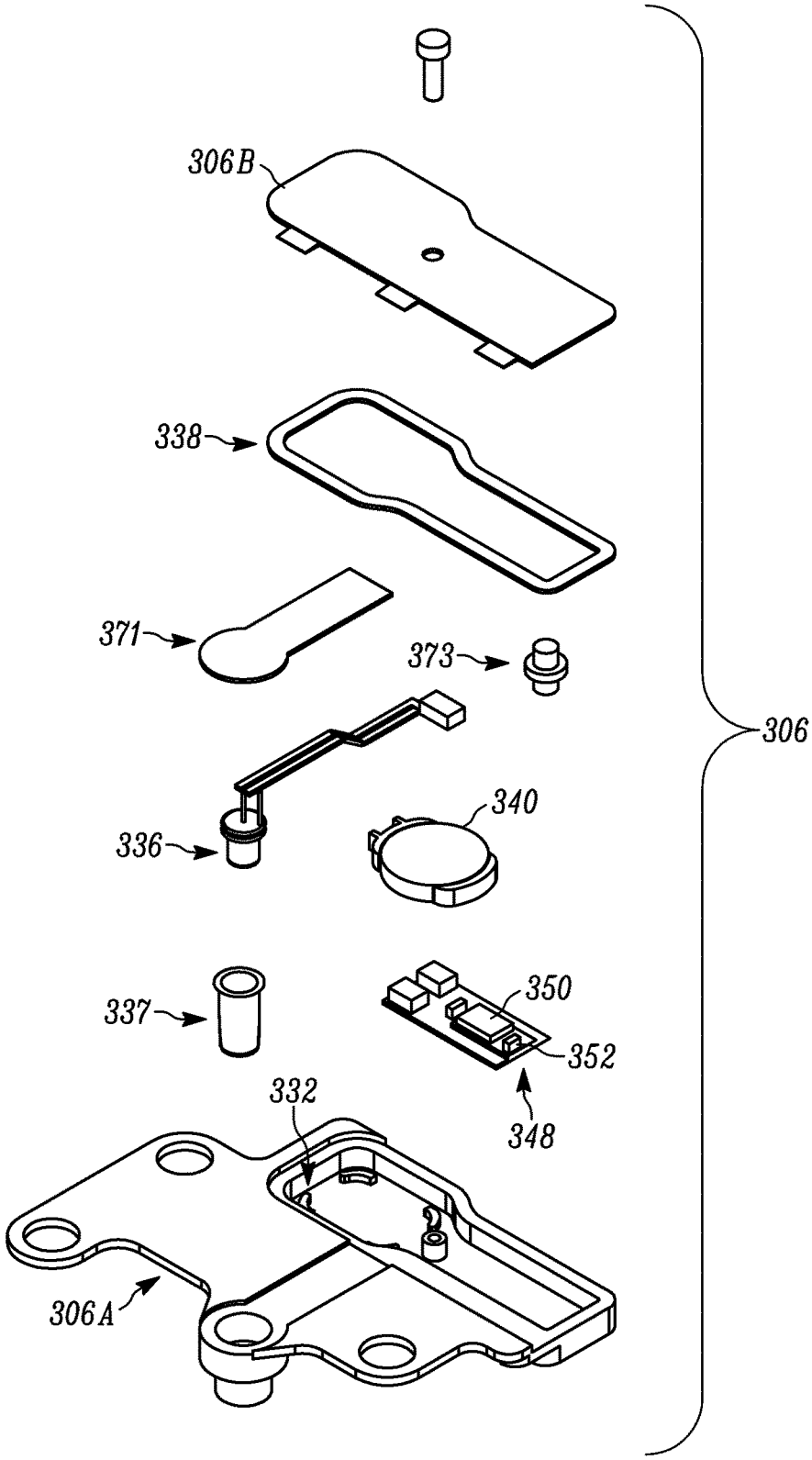
FIG. 23 is an exploded assembly view of the holster spacer of FIG. 14.
Figure 25:
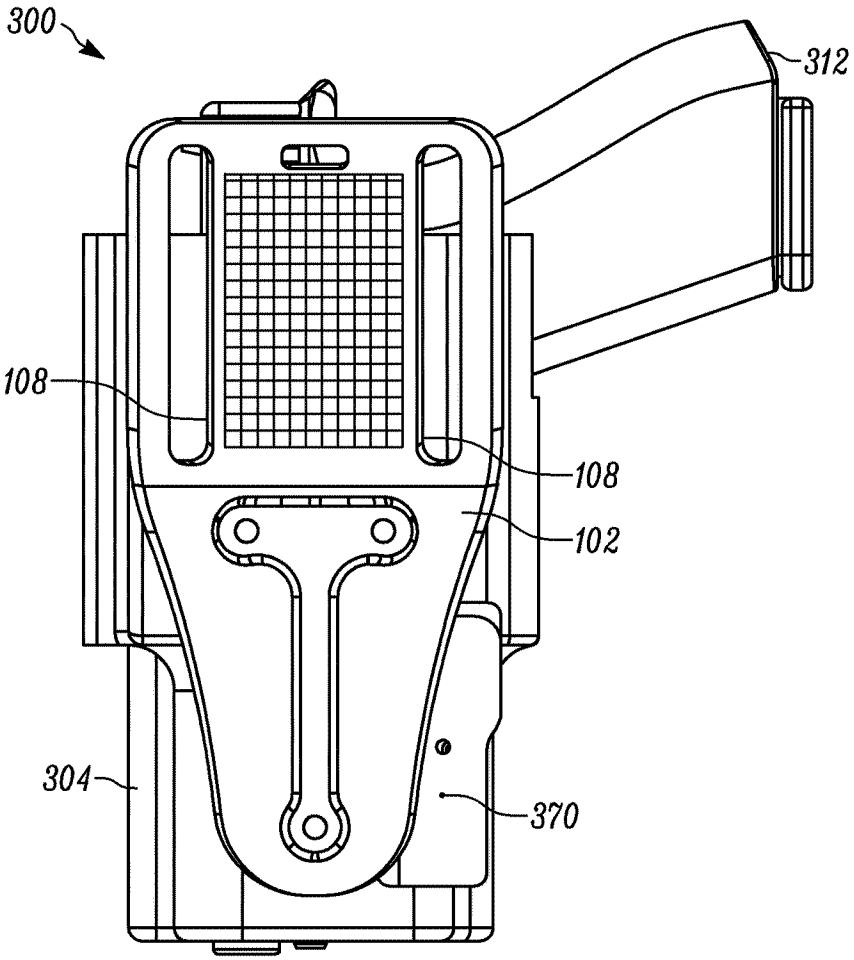
FIG. 25 is a front view of the holster assembly of FIG. 24.
Figure 24:
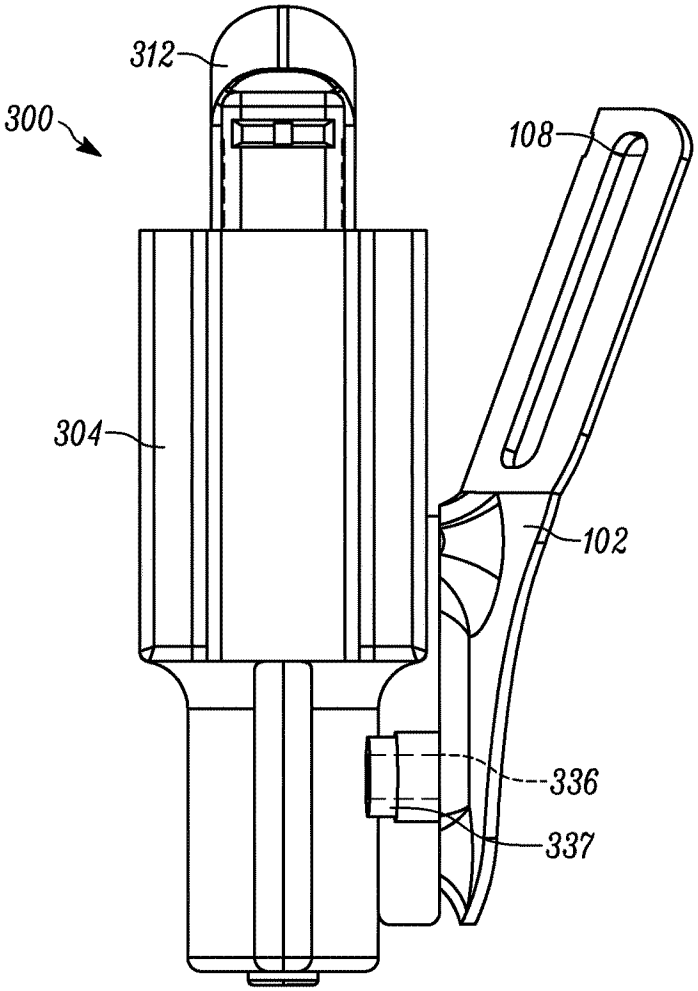
FIG. 24 is a left side view of a holster assembly for a weapon, including the holster spacer of FIG. 14.
Figure 26:
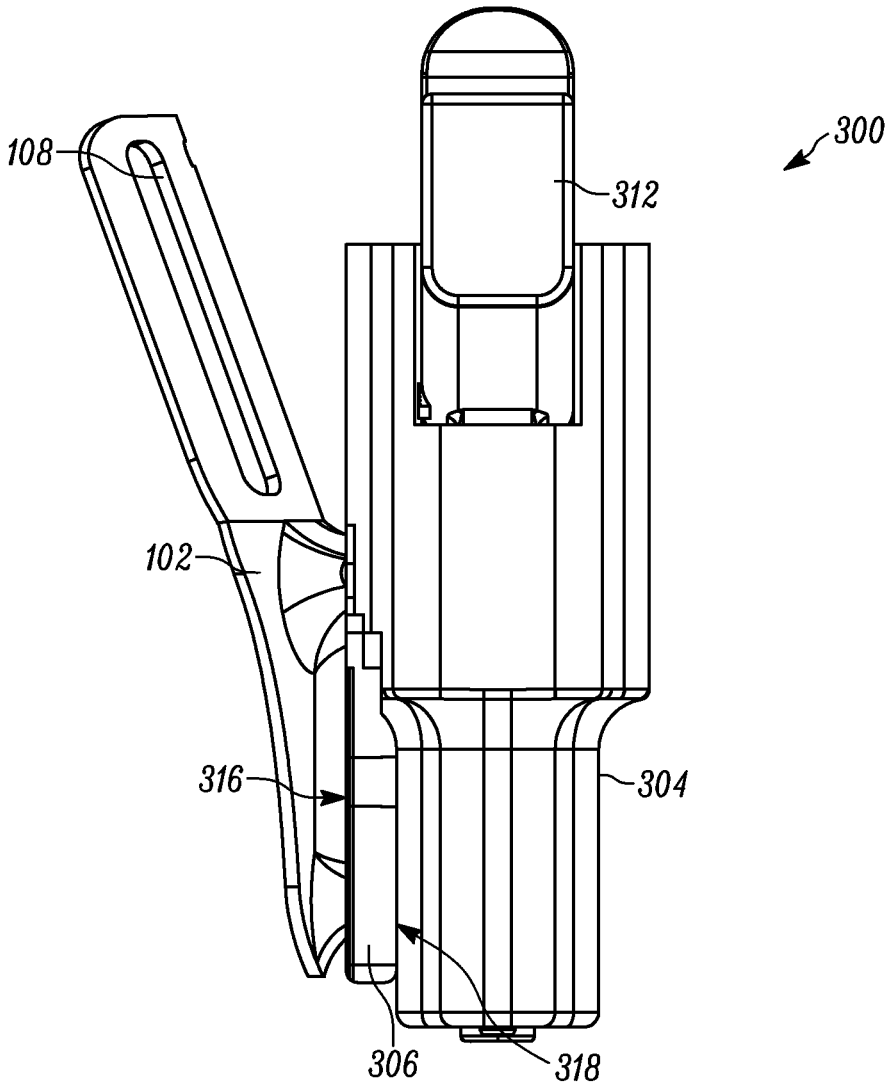
FIG. 26 is a right side view of the holster assembly of FIG. 24.
Figure 27:
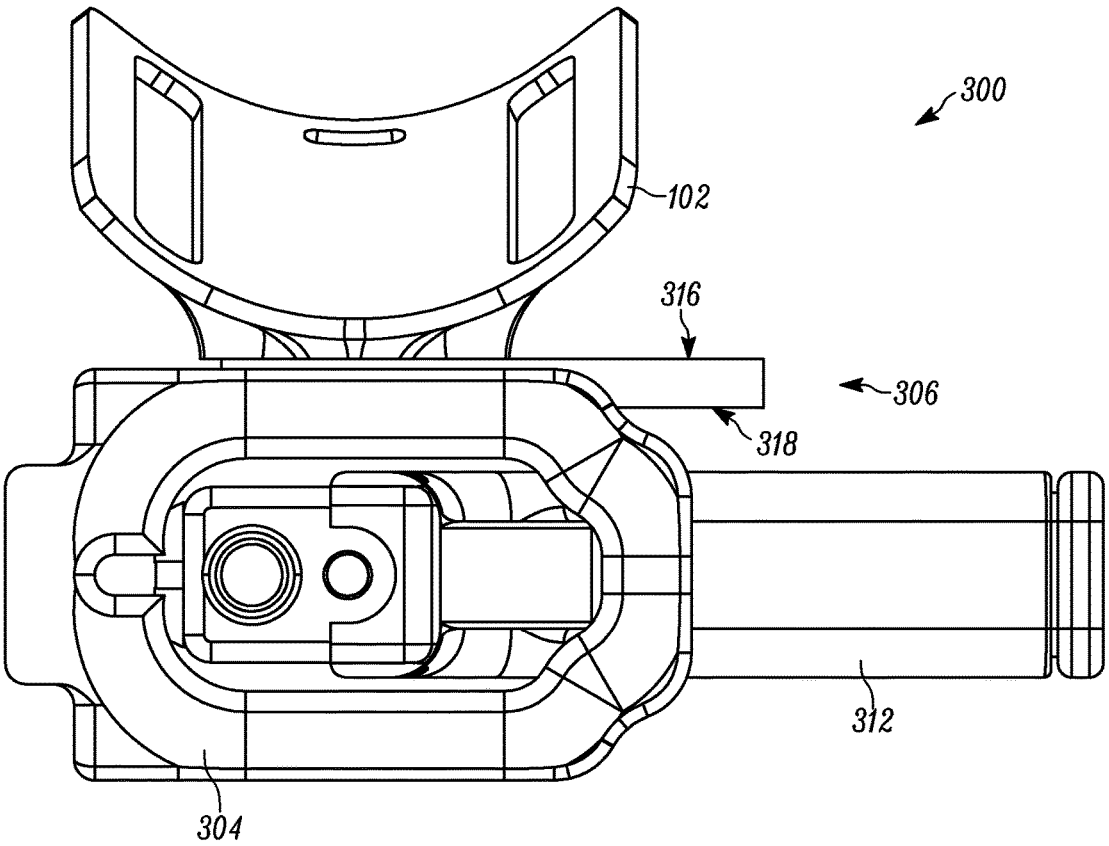
FIG. 27 is a bottom view of the holster assembly of FIG. 24.
Figure 28:
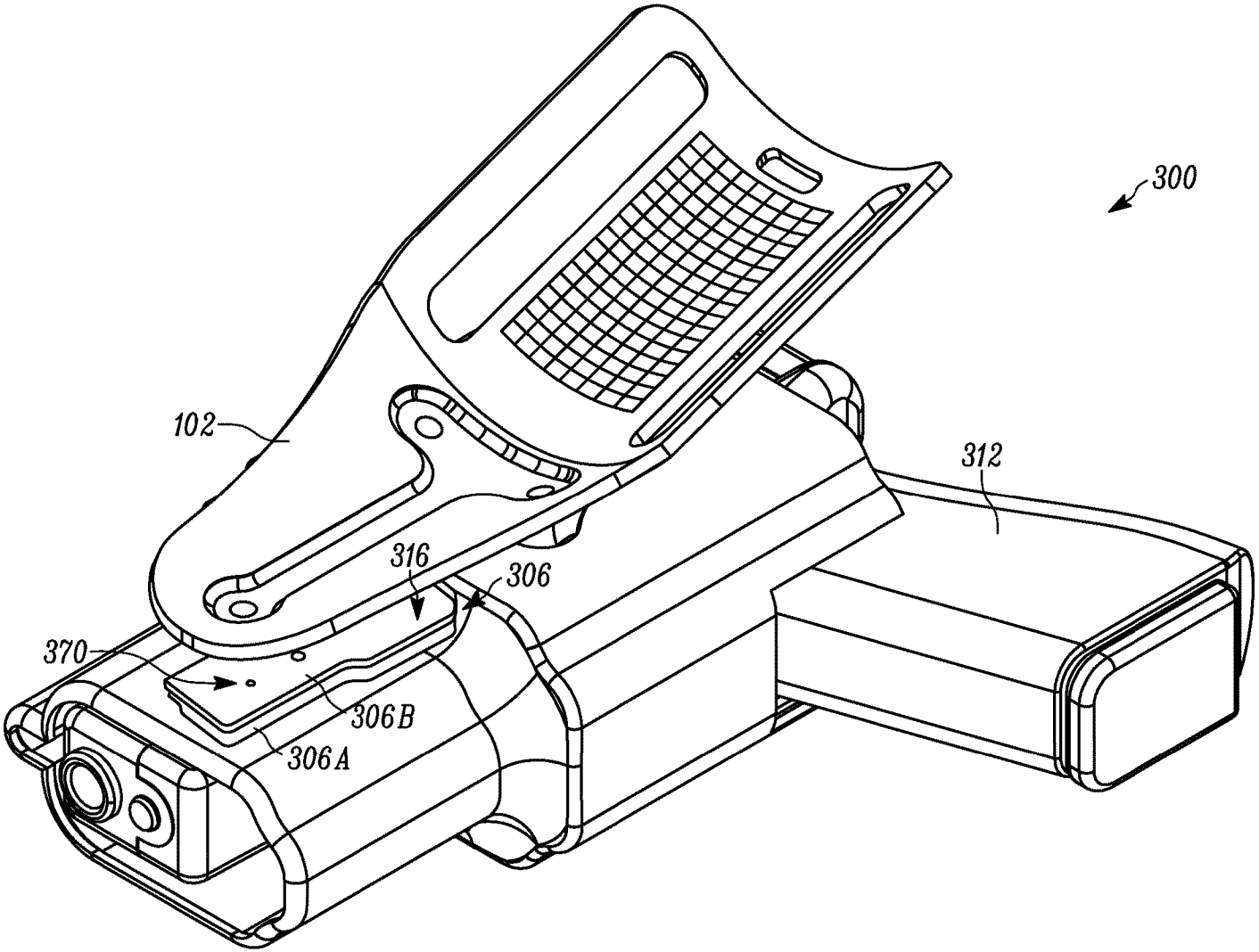
FIG. 28 is a perspective view of the holster assembly of FIG. 24.

The holster spacer 306 includes a user interface 370 in communication with a user input-output module of the processor (not shown). The user interface 370, which may take a variety of forms, is shown to include an indicator light (e.g., a light emitting diode). The user interface 370 can be selectively illuminated to indicate a status of the holster spacer 306 (e.g., function status, operational mode, battery condition, etc.) and/or a status of the pistol 312 or other holstered implement. As shown in FIG. 23, a light pipe 373 can be provided to direct the light emitted from the indicator light on the printed circuit board assembly 348 to the outside of the housing portion 306B. The user interface 370 can optionally include a touch screen or a separately provided display screen and control button(s). Alternatively or in addition to the indicator light, the user interface 370 can include any one or more of: a piezo buzzer, a speaker, a vibrator, and a haptic micro-electric-mechanical device. As shown, the user interface 370 is provided on a portion of the holster spacer 306 that is spaced away from the mounting interface and partially or fully exposed when the holster spacer 306 is coupled between the wearable component 102 and the holster 304 as shown in FIGS. 24 through 30.

Figure 22:
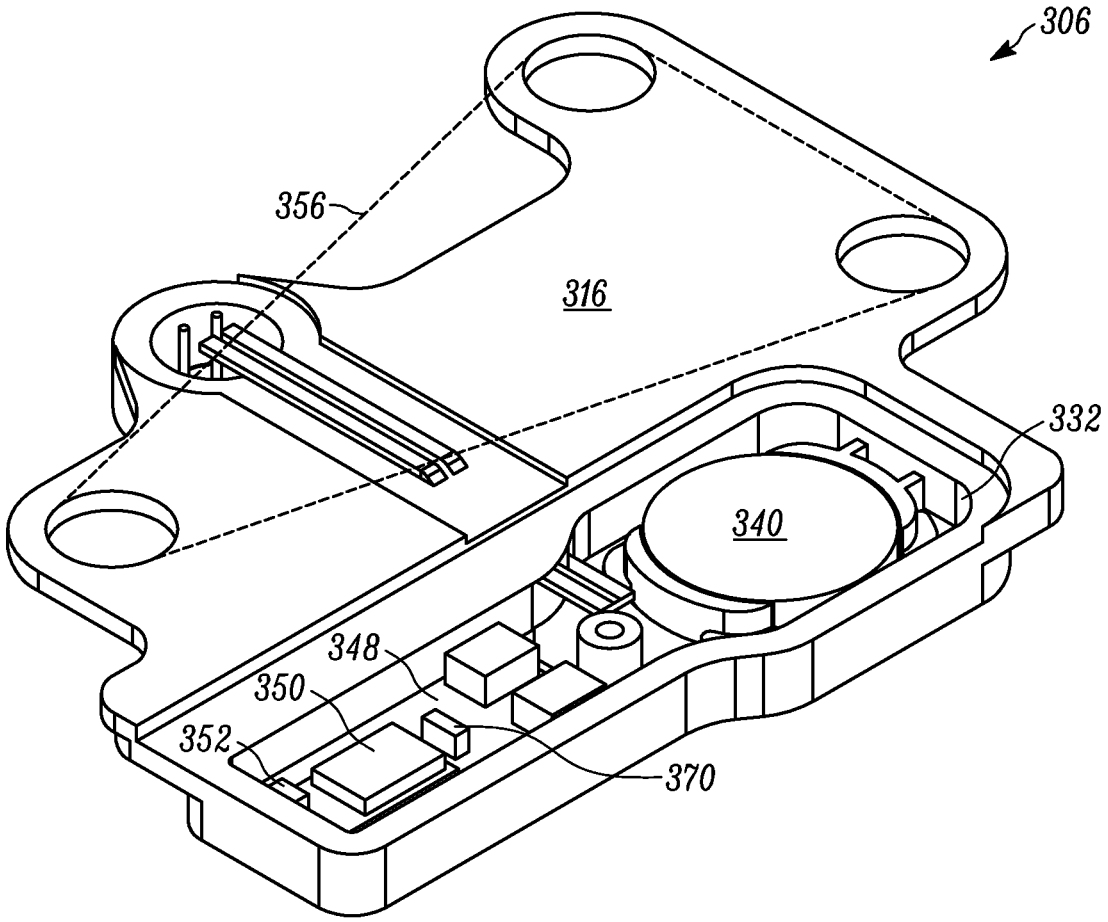
FIG. 22 is a perspective view illustrating the internals of the holster spacer of FIG. 14.

Because the sensor 336 is spaced apart (e.g., on opposite sides of the mounting interface) from the internal cavity 332 containing the electronic circuitry, a length of wiring extends across the holster spacer 306 as shown in FIGS. 22 and 23. For example, a wiring channel is formed in the housing portion 306A. A separate wiring cover 371 can be provided to enclose the wiring channel once the wires are passed during assembly. The wiring cover 371 may also cover a rear side of the pocket or recess that receives the sensor 336.

Figure 17:
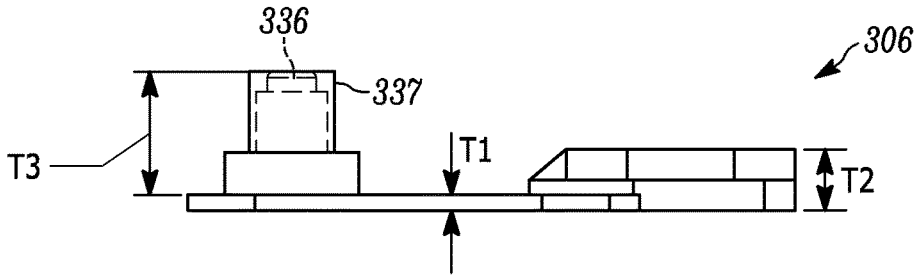
FIG. 17 is a top view of the holster spacer of FIG. 14.
Figure 18:
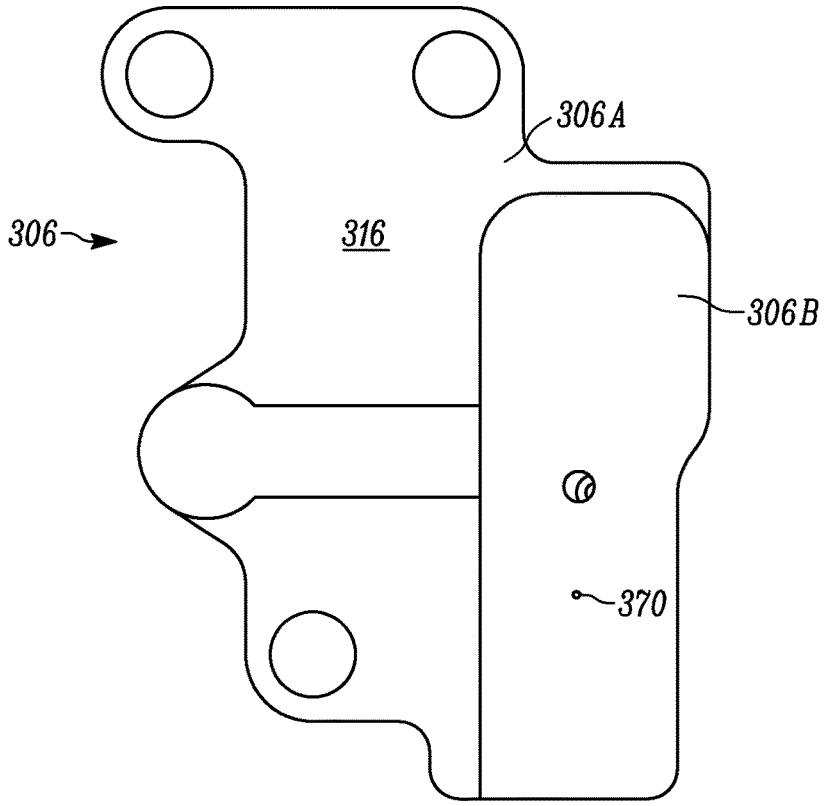
FIG. 18 is a front view of the holster spacer of FIG. 14.
Figure 19:
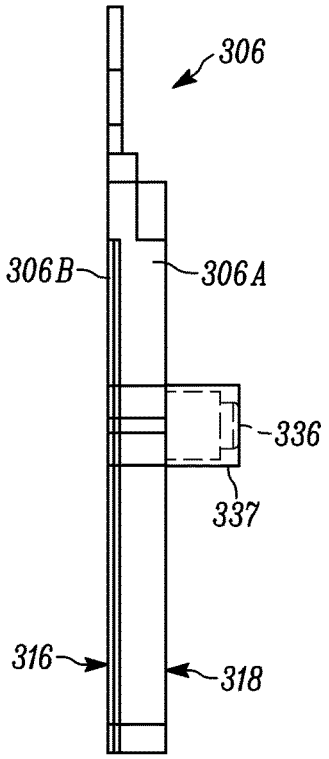
FIG. 19 is a right side view of the holster spacer of FIG. 14.
Figure 20:
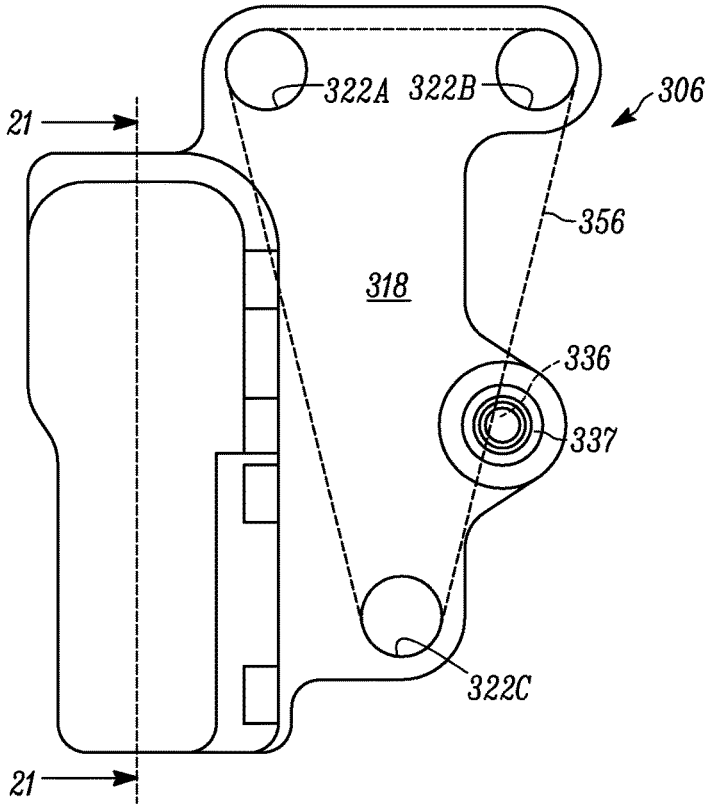
FIG. 20 is a rear view of the holster spacer of FIG. 14.
Figure 21:
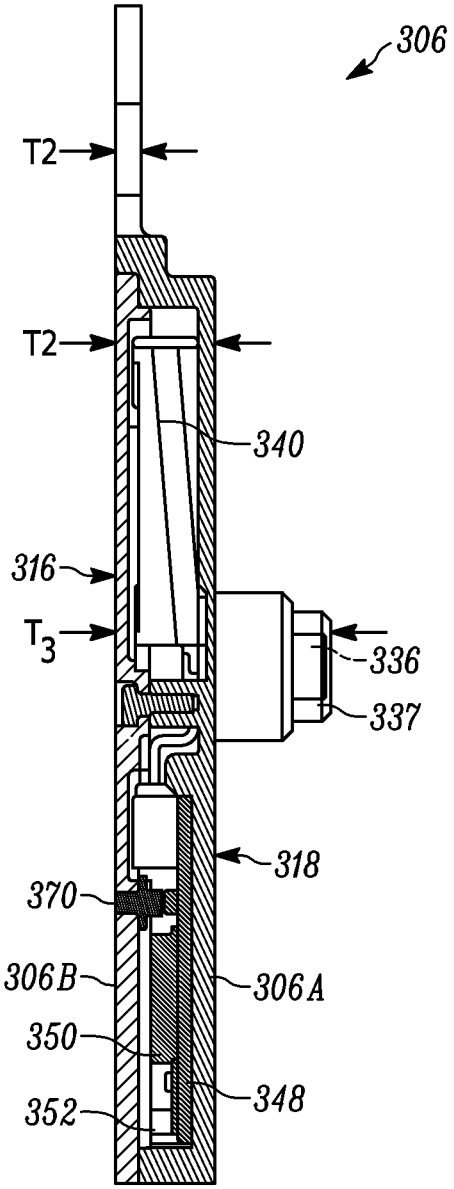
FIG. 21 is a cross-section view of the holster spacer of FIG. 14, taken along line 21-21 of FIG. 20.

As illustrated in FIGS. 17 and 21, the holster spacer 306 has a first area having a first thickness T1 and a second area having second thickness T2, greater than the first thickness T1. All or a majority of the first area falls within the imaginary envelope area 356, while all or a majority of the second area falls outside of the imaginary envelope area 356. The sensor 336 of the holster spacer 306 projects outwardly from the holster-facing surface 318 in the area of the first thickness T1 to define a third thickness T3 that is at least 3, 4, or 5 times greater than the first thickness T1. However, the sensor 336 and sensor sleeve 337 can be received by a recess in the mating holster 304 such that the effective spacing distance provided by the holster spacer 306 is equal to T1. In cases where the objective of the user is not to add a substantial spacing distance, the first thickness T1 can be kept minimal (6 mm or less, 4 mm or less) since the sensor 336 and the electronic circuitry are generally positioned outside the imaginary envelope area 356 as shown in FIGS. 20 and 22.

Figure 29:
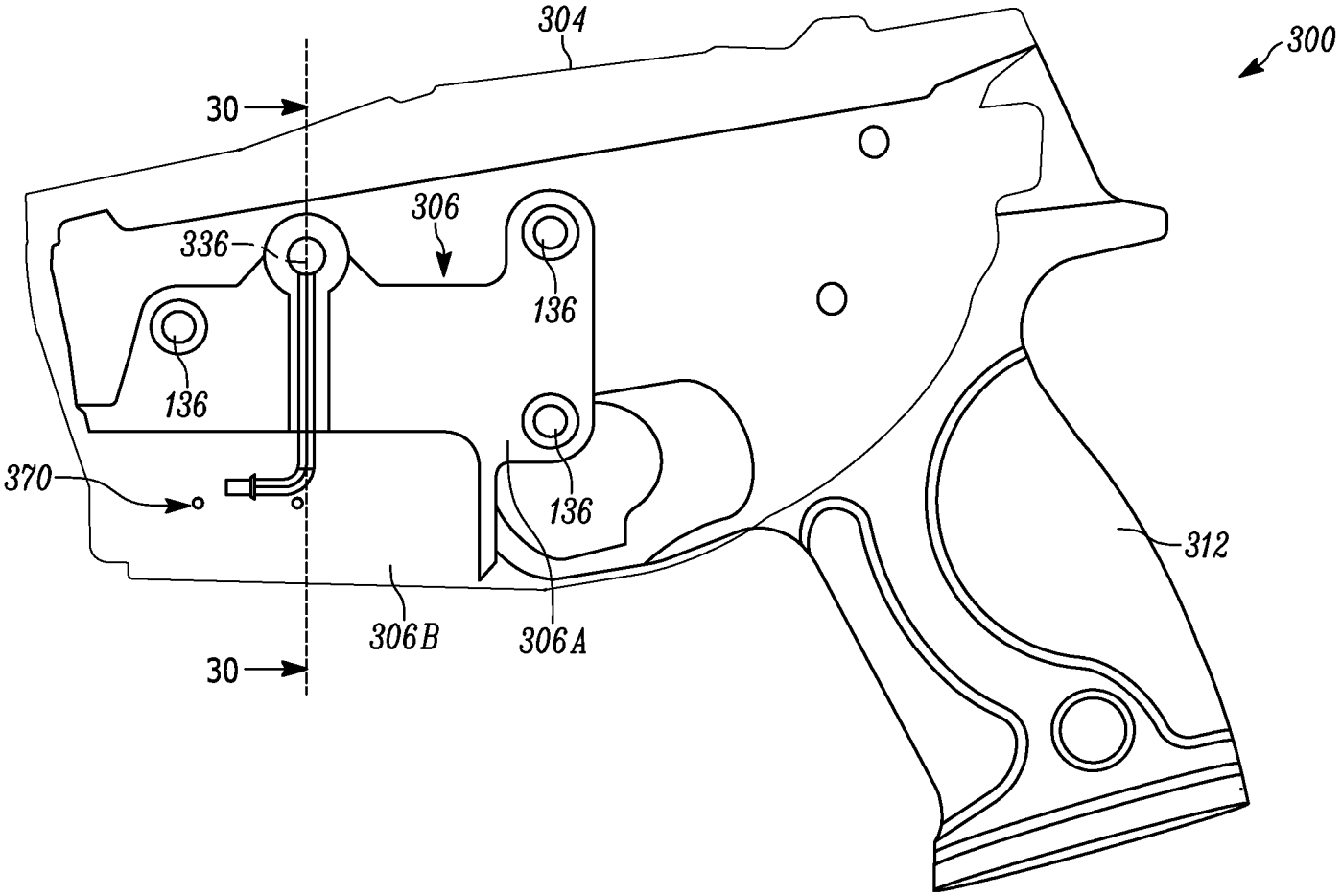
FIG. 29 is a rear view of the holster assembly of FIG. 24.
Figure 30:
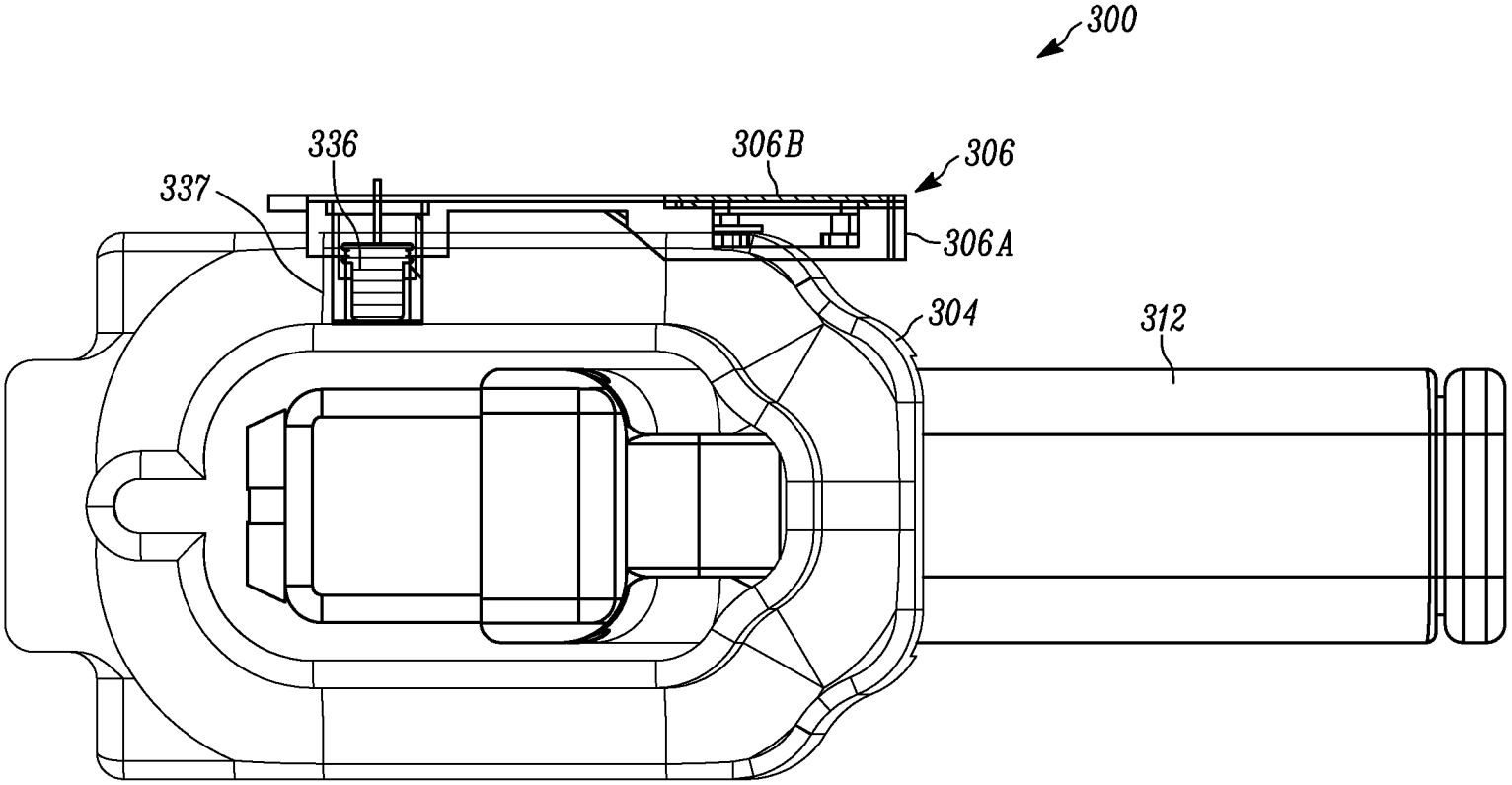
FIG. 30 is a cross-section view of the holster assembly, taken along line 30-30 of FIG. 29.

FIGS. 29 and 30 illustrate the positioning of the holster spacer 306, and in particular the sensor 336, with respect to the pistol 312. As shown, the holster spacer 306 may be designed so that the sensor 336 is aligned in register with an axis of a barrel of the pistol 312 (i.e., an axis of the sensor 336 is perpendicular with and intersects an axis defined by the barrel). Where the operability of the sensor 336 depends on close proximity to the pistol 312 or other implement, FIG. 30 illustrates that the tip of the sensor 336 may be nearly in contact with the pistol 312 (2 mm or less, 1 mm or less). The proximity of the sensor 336 to the pistol 312, or sensor depth as expressed with respect to the holster-facing surface 318 can be adjusted as mentioned above by using an alternate sensor sleeve 337 while the remaining components are re-used, unchanged. In some constructions, the sensor depth can be adjusted by adding one or more spacers between the sensor 336 and the housing portion 306A to control the ultimate distance of the sensor 336 and/or the sensor sleeve 337.

Figure 31:
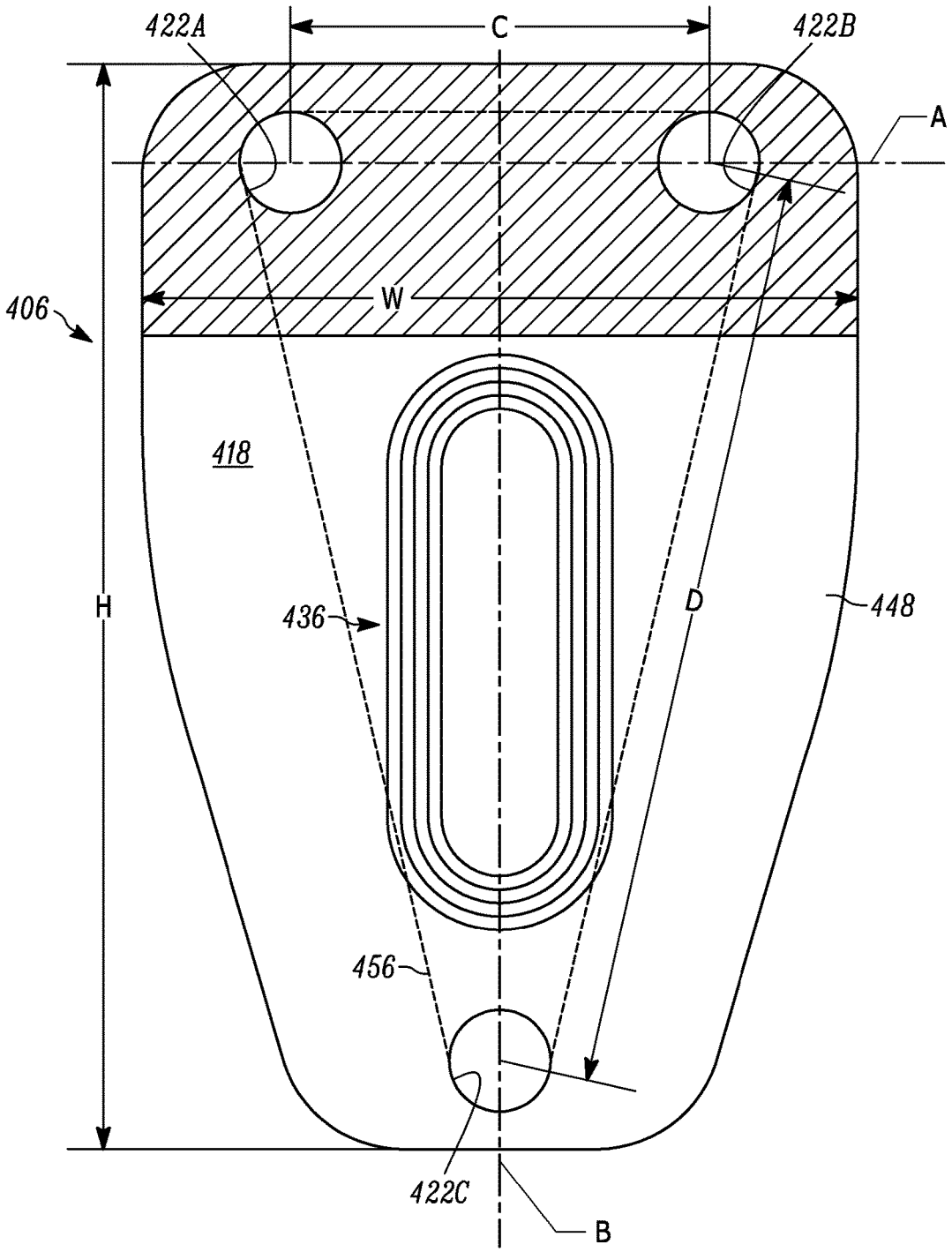
FIG. 31 is a schematic front view of a holster spacer in accordance with some embodiments.

FIG. 31 illustrates a holster spacer 406 according to another embodiment. Although not shown, it will be understood that the holster spacer 406 may be provided between a wearable component and a holster as part of a holster assembly similar to the holster assembly 100 as shown in FIG. 1. It is also noted that reference numbers for similar features and elements are kept in order, similar to those of FIGS. 1 through 3, but incremented by 300. The description of the holster spacer 406 of FIG. 31 focuses primarily on the features that are unique from the holster spacers 106, 206, 306 of FIGS. 1 through 3, FIGS. 4 through 13, and FIGS. 14 through 30, respectively, with the understanding that the holster spacer 406 can include any and all of the features disclosed above with reference to the holster spacers 106, 206, 306, except where expressly prohibited.

The holster spacer 406 includes a sensor 436 in the form of an inductive coil as shown, although other sensor types are optional, including those mentioned above. The sensor 436 is in communication with electronic circuitry as described above. For example, although not shown, the holster spacer 406 can include a power source and a communication module having a processor and optionally a transceiver. The electronic circuitry can be located in an area, indicated by the cross-hatching, at the first end of the holster spacer 406, where the first and second apertures 422A, 422B are located. As shown, a width W of the holster spacer 406, measured parallel to the first axis A, may have a maximum value at the first end in the area receiving the electronic circuitry, and the width W may decrease toward the second end where the third aperture 422C is located. When used with a belt adapter as shown in FIGS. 1 through 3, the electronics layout of FIG. 31 locates the electronic circuitry at a top end of the holster spacer 406, for example, within the top third or a top quarter of a height H of the holster spacer 406, measured parallel to the second axis B. Although a separate housing or housings may optionally be provided, the area of the holster spacer 406 as viewed perpendicular to both the first and second axes A, B may be entirely or substantially entirely occupied by a printed circuit board assembly 448 such that the first, second, and third apertures 422A, 422B, 422C are formed directly in a substrate of the printed circuit board assembly 448.

Figure 32:
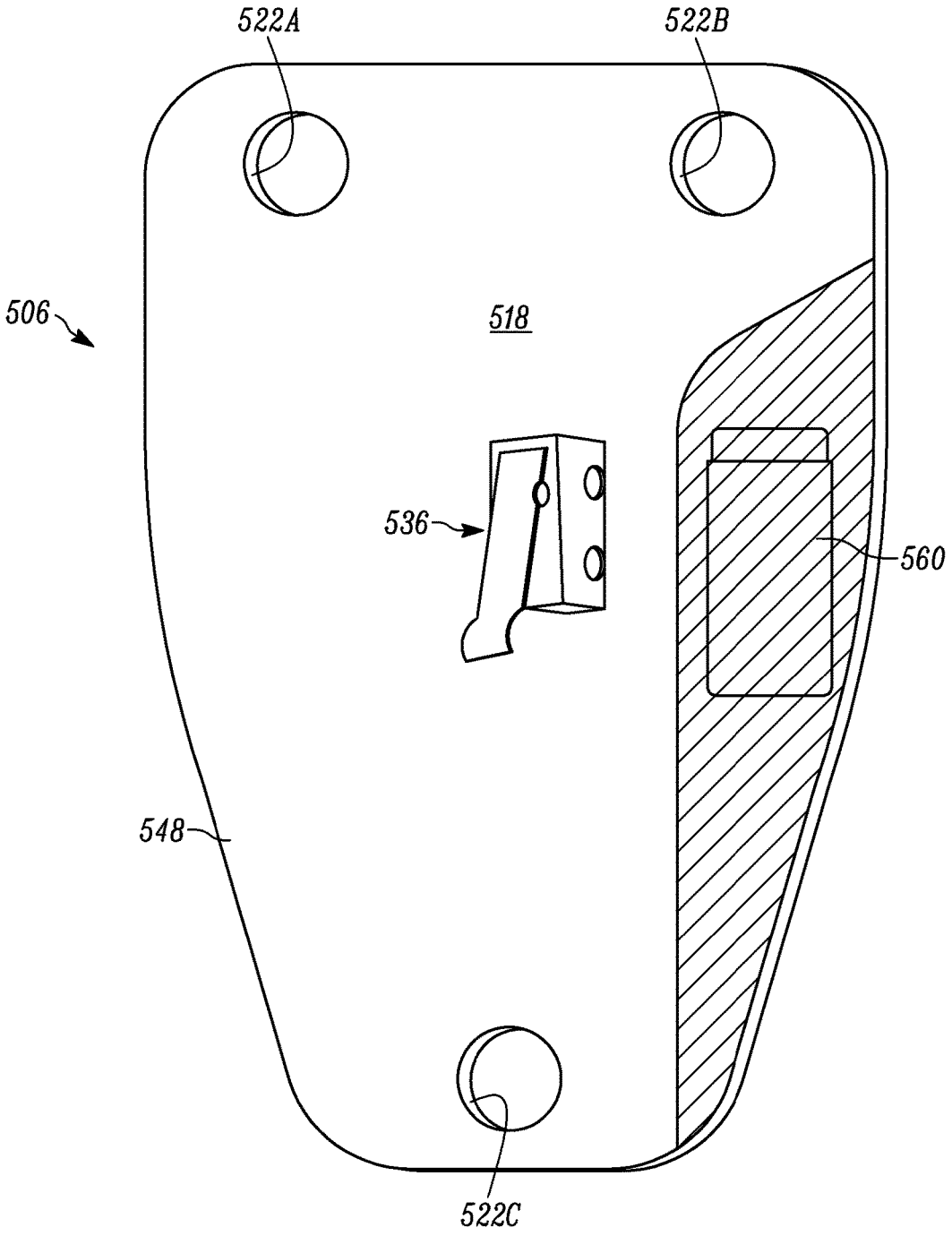
FIG. 32 is a schematic perspective view of a holster spacer in accordance with some embodiments.
Figure 33:
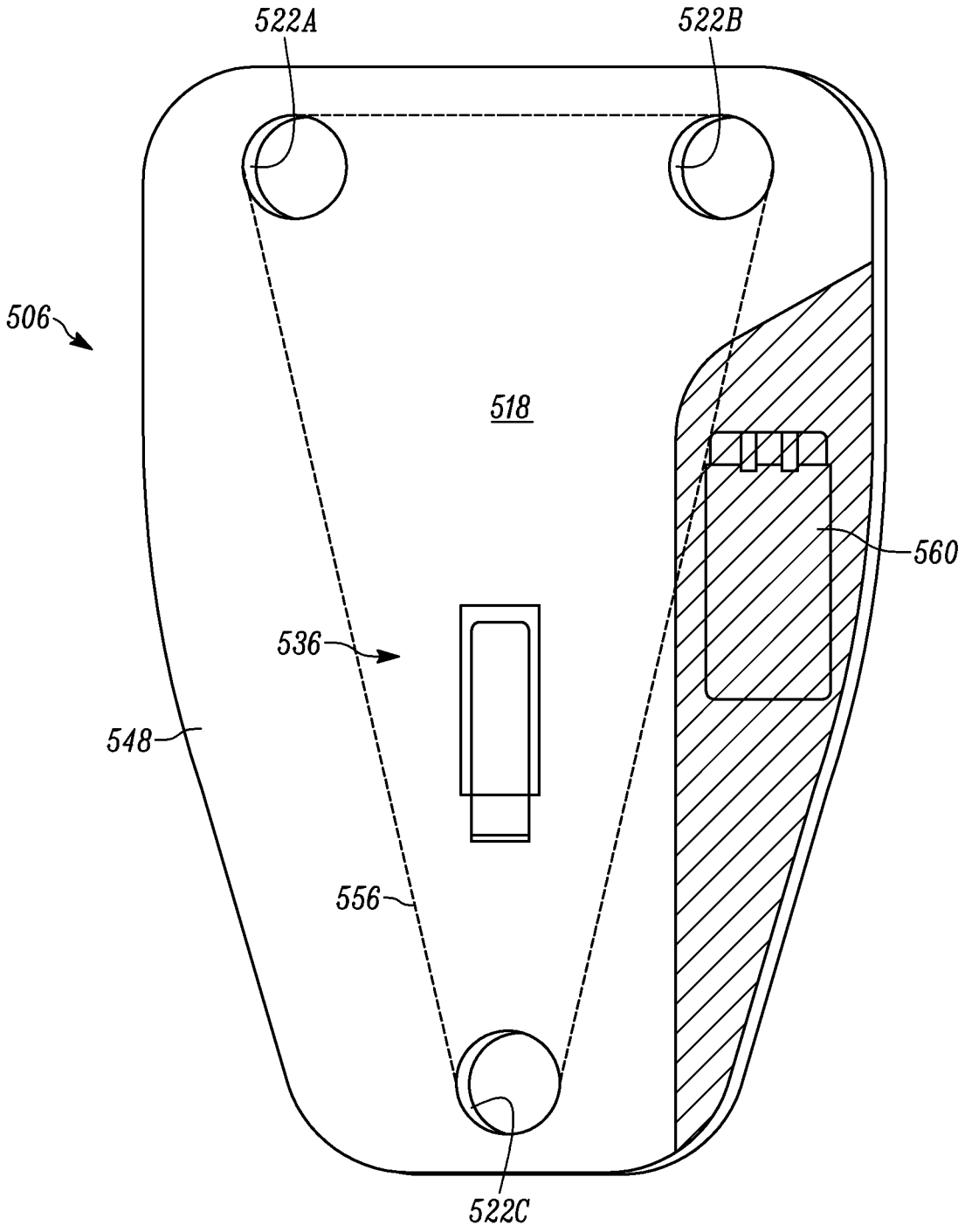
FIG. 33 is a schematic front view of the holster spacer of FIG. 32.

FIGS. 32 and 33 illustrate a holster spacer 506 according to another embodiment. Although not shown, it will be understood that the holster spacer 506 may be provided between a wearable component and a holster as part of a holster assembly similar to the holster assembly 100 as shown in FIG. 1. It is also noted that reference numbers for similar features and elements are kept in order, similar to those of FIGS. 1 through 3, but incremented by 400. The description of the holster spacer 506 of FIGS. 32 and 33 focuses primarily on the features that are unique from the holster spacers 106, 206, 306, 406 of FIGS. 1 through 3, FIGS. 4 through 13, FIGS. 14 through 30, and FIG. 31, respectively, with the understanding that the holster spacer 506 can include any and all of the features disclosed above with reference to the holster spacers 106, 206, 306, 406, except where expressly prohibited.

The holster spacer 506 includes a sensor 536 in the form of a mechanical switch as shown, although other sensor types are optional, including those mentioned above. Although not required, the illustrated holster spacer 506 can be used with a holster sized and shaped to receive a conducted electrical weapon (not shown). The sensor 536 is in communication with electronic circuitry as described above. For example, although not shown, the sensor 536 can communicate with a communication module having a processor and optionally a transceiver. However, some or all of the electronic circuitry in communication with the sensor 536 may be positioned remotely, away from the holster spacer 506. As such, the holster spacer 506 includes an electrical connector 560 (e.g., plug type) for establishing communication between the sensor 536 and remote electronic circuitry. The electrical connector 560 can be located in an area, indicated by the cross-hatching, at a side edge of the holster spacer 506. Alternately, some or all of the electronic circuitry can be located on-board the holster spacer 506 in the cross-hatched area. Although a separate housing or housings may optionally be provided, the area of the holster spacer 506 as viewed perpendicular to both the first and second axes A, B may be entirely or substantially entirely occupied by a printed circuit board assembly 548 such that the first, second, and third apertures 522A, 522B, 522C are formed directly in a substrate of the printed circuit board assembly 548.

Figure 35:
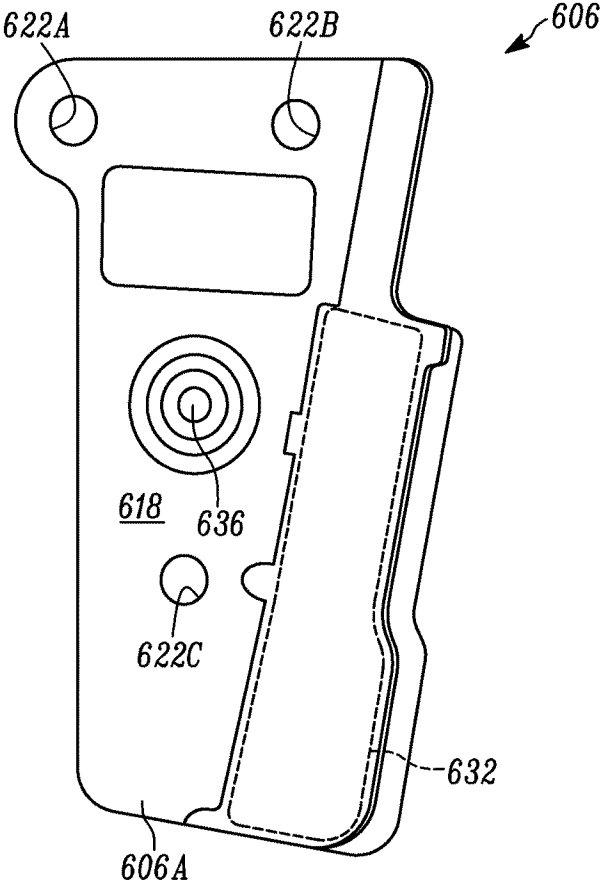
FIG. 35 is a front view of the holster spacer of FIG. 34.
Figure 34:
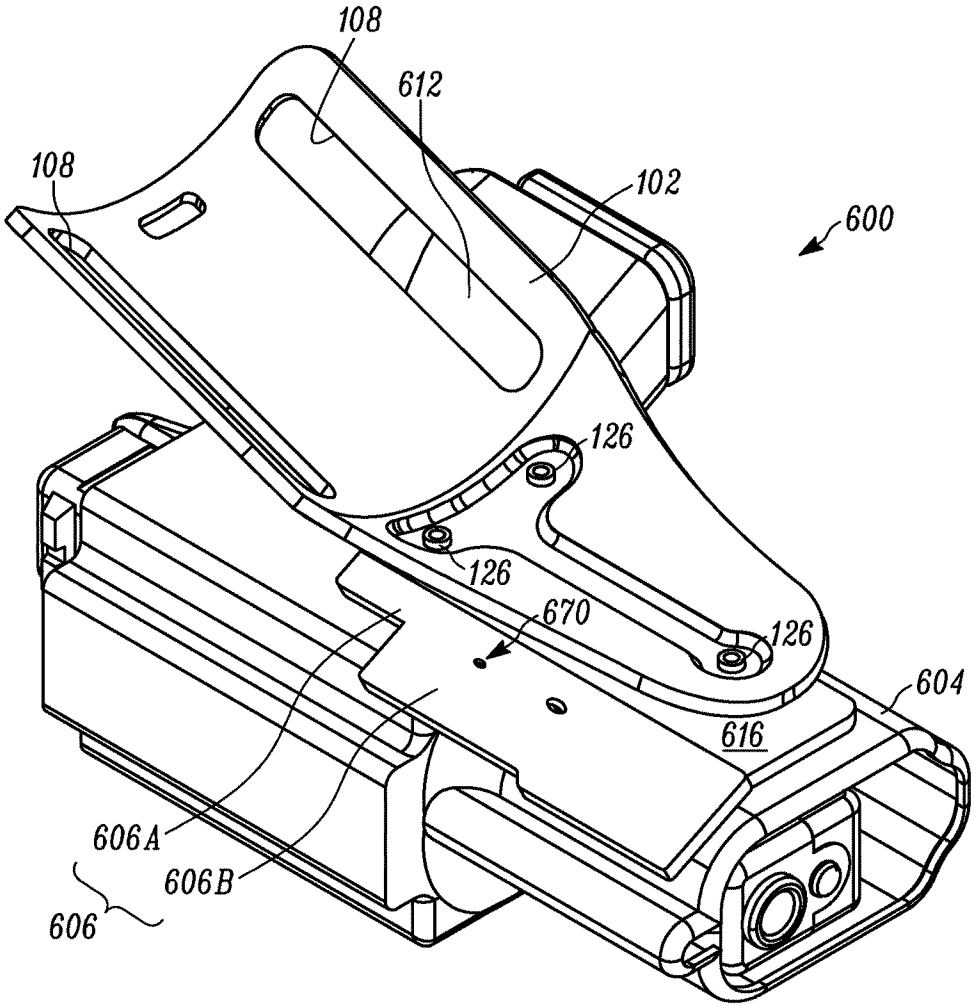
FIG. 34 is a perspective view of a holster spacer having a user interface in accordance with some embodiments, the holster spacer incorporated with a holster assembly for a weapon.

FIGS. 34 and 35 illustrate a holster assembly 600 including a holster spacer 606 according to another embodiment.

The holster spacer 606 is provided between a wearable component 102 similar to that shown in FIG. 1 a holster 604 shaped and sized for a different type of pistol 612 compared to the holsters 104, 304 and the pistols 112, 312 of FIGS. 1 and 10. It is also noted that reference numbers for similar features and elements are kept in order, similar to those of FIGS. 1 through 3, but incremented by 500. The description of the holster spacer 606 of FIGS. 34 and 35 focuses primarily on the features that are unique from the holster spacers 106, 206, 306, 406, 506 of FIGS. 1 through 3, FIGS. 4 through 13, FIGS. 14 through 30, FIG. 31, and FIGS. 32 through 33, respectively, with the understanding that the holster spacer 606 can include any and all of the features disclosed above with reference to the holster spacers 106, 206, 306, 406, 506, except where expressly prohibited.

The holster spacer 606 includes a user interface 670 in communication with a user input-output module of the processor (not shown). The user interface 670, which may take a variety of forms, is shown to include an indicator light (e.g., a light emitting diode). The user interface 670 can be selectively illuminated to indicate a status of the holster spacer 606 (e.g., function status, operational mode, battery condition, etc.) and/or a status of the pistol 612 or other holstered implement. The user interface 670 can optionally include a touch screen or a separately provided display screen and control button(s). Alternatively or in addition to the indicator light, the user interface 670 can include any one or more of: a piezo buzzer, a speaker, a vibrator, and a haptic micro-electric-mechanical device. As shown, the user interface 670 is provided on a portion of the holster spacer 606 that is spaced away from the mounting interface and partially or fully exposed when the holster spacer 606 is coupled between the wearable component 102 and the holster 604. Furthermore, the user interface 670 can be provided on a portion of the holster spacer 606 that is oriented at an angle from the portion of the holster spacer 606 having the mounting interface. The angle is greater than zero and up to 90 degrees (e.g., between 20 degrees and 60 degrees). Although not illustrated, it will be understood that the details of the sensor 636 and the electronic circuitry within the internal cavity 632 may be in accordance with any of the embodiments described herein.

Figure 36:
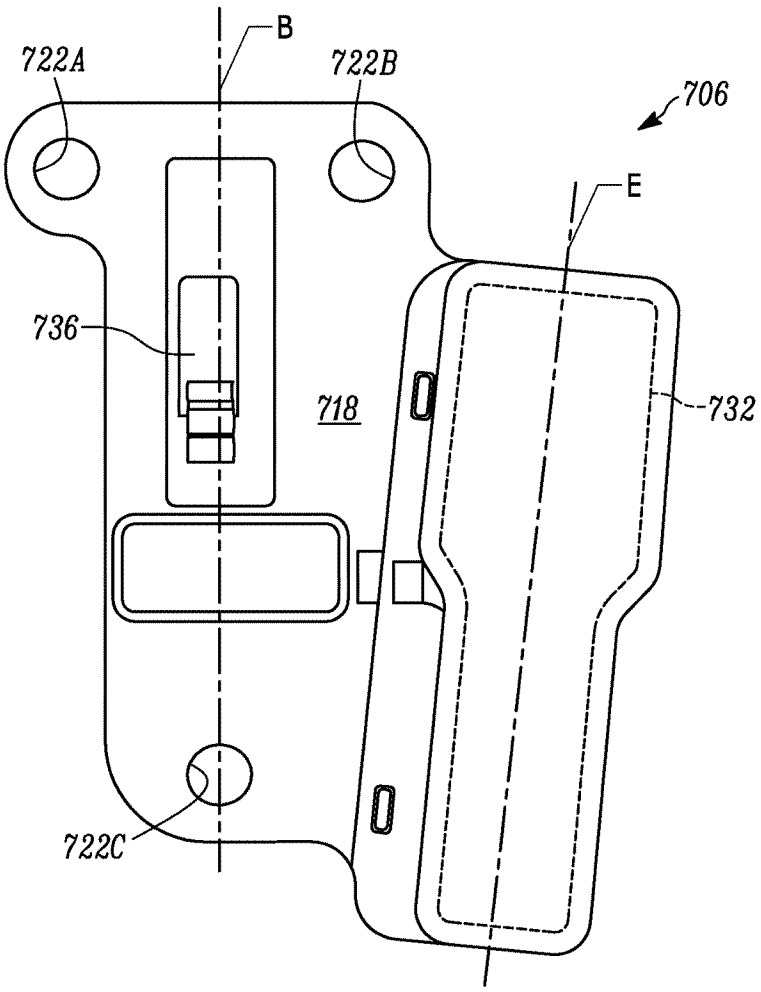
FIG. 36 is a front view of a holster spacer in accordance with some embodiments.
Figure 40:
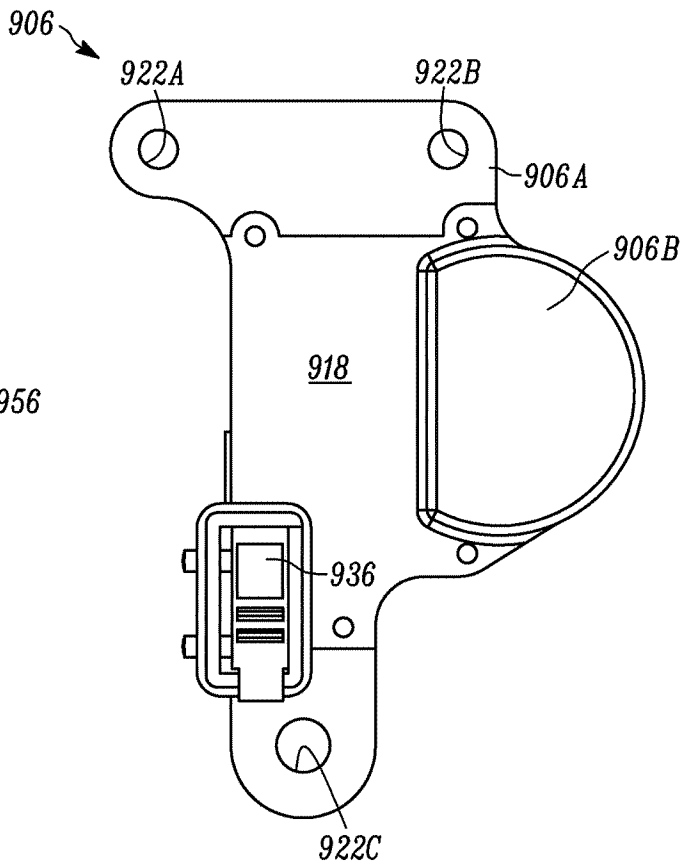
FIG. 40 is a rear view of the holster spacer of FIG. 38.
Figure 39:
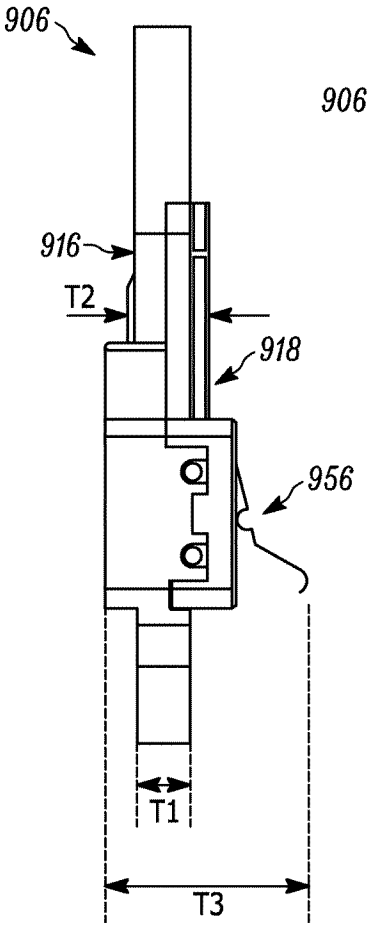
FIG. 39 is a right side view of the holster spacer of FIG. 38.
Figure 38:
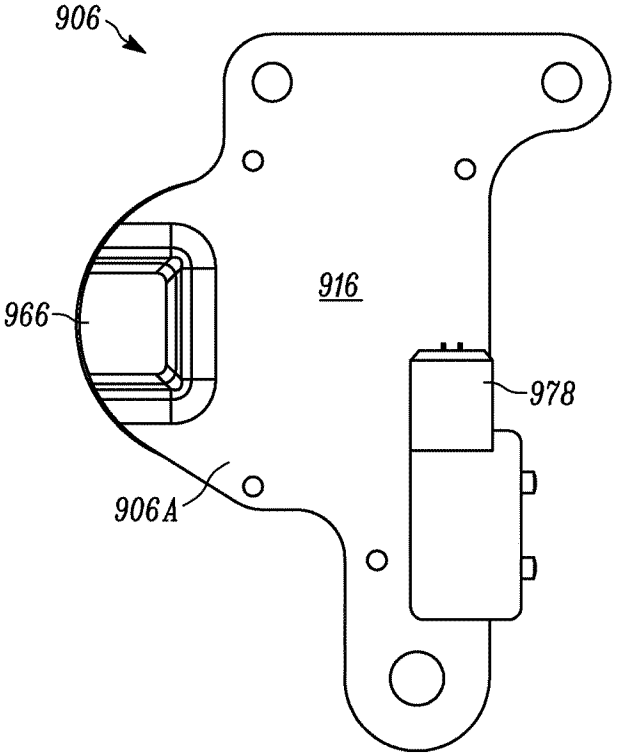
FIG. 38 is a front view of a holster spacer in accordance with some embodiments.
Figure 41:
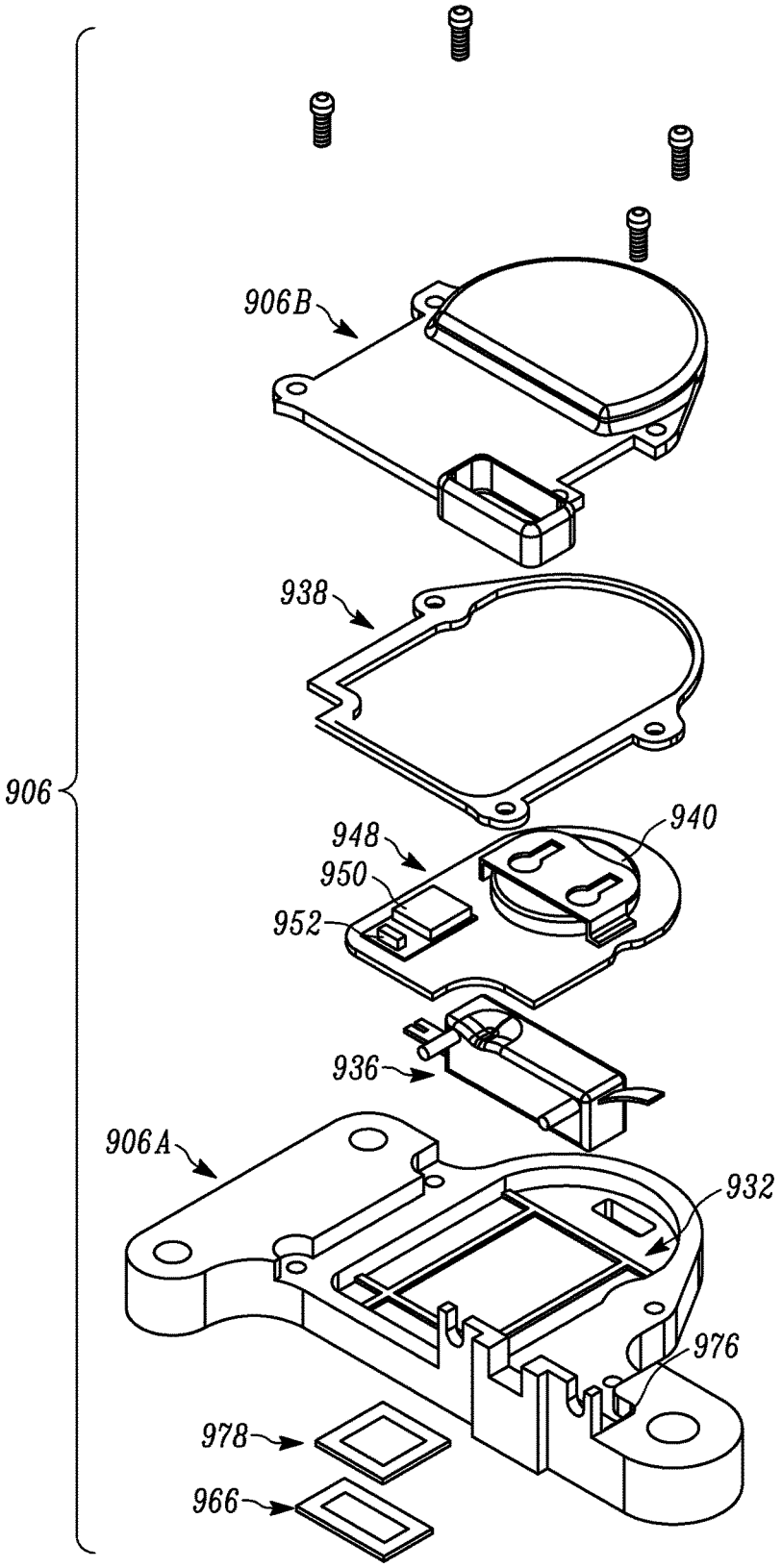
FIG. 41 is an exploded assembly view of the holster spacer of FIG. 38.

FIG. 36 illustrates a holster spacer 706 according to another embodiment. Although not shown, it will be understood that the holster spacer 406 may be provided between a wearable component and a holster as part of a holster assembly similar to the holster assembly 100 as shown in FIG. 1. It is also noted that reference numbers for similar features and elements are kept in order, similar to those of FIGS. 1 through 3, but incremented by 600. The description of the holster spacer 706 of FIG. 36 focuses primarily on the features that are unique from the holster spacers 106, 206, 306, 406, 506, 606 of FIGS. 1 through 3, FIGS. 4 through 13, FIGS. 14 through 30, FIG. 31, FIGS. 32 through 33, and FIGS. 34 through 35, respectively, with the understanding that the holster spacer 706 can include any and all of the features disclosed above with reference to the holster spacers 106, 206, 306, 406, 506, 606, except where expressly prohibited.

As shown in FIG. 36, the holster spacer 706 includes an internal cavity 732 for enclosing electronic circuitry in communication with the sensor 736. The internal cavity 732 defines an axis of elongation E about which the internal cavity 732 has symmetry in whole or in part. The axis of elongation E is not parallel with the second axis B, which extends through and bisects the mounting interface of the holster spacer 706, and further extends through the sensor 736 as shown. Rather, the axis of elongation E is angled to approach the second axis B in a direction from the first end having the first and second apertures 722A, 722B toward the second end having the third aperture 722C (i.e., a downward direction as illustrated). The sensor 736 is a mechanical switch as shown, but other alternatives are optional as disclosed herein. The angle of skew between the second axis B and the axis of elongation E can be less than 15 degrees and may be configured to match the contour of a designated holster (not shown).

Figure 37:
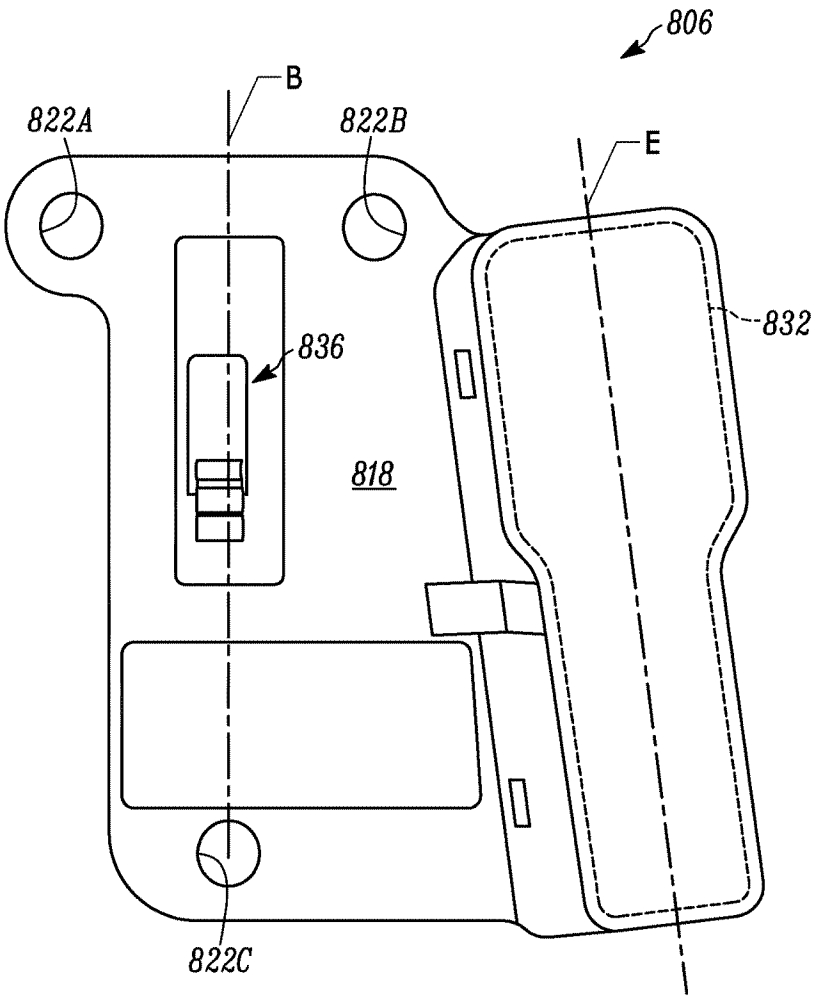
FIG. 37 is a front view of a holster spacer in accordance with some embodiments.

FIG. 37 illustrates a holster spacer 806 according to another embodiment. Although not shown, it will be understood that the holster spacer 806 may be provided between a wearable component and a holster as part of a holster assembly similar to the holster assembly 100 as shown in FIG. 1. It is also noted that reference numbers for similar features and elements are kept in order, similar to those of FIGS. 1 through 3, but incremented by 700. The description of the holster spacer 806 of FIG. 37 focuses primarily on the features that are unique from the holster spacers 106, 206, 306, 406, 506, 606, 706 of FIGS. 1 through 3, FIGS. 4 through 13, FIGS. 14 through 30, FIG. 31, FIGS. 32 through 33, FIGS. 34 through 35, and FIG. 36, respectively, with the understanding that the holster spacer 806 can include any and all of the features disclosed above with reference to the holster spacers 106, 206, 306, 406, 506, 606, 706, except where expressly prohibited.

As shown in FIG. 37, the holster spacer 806 includes an internal cavity 832 for enclosing electronic circuitry in communication with the sensor 836. The internal cavity 832 defines an axis of elongation E about which the internal cavity 832 has symmetry in whole or in part. The axis of elongation E is not parallel with the second axis B, which extends through and bisects the mounting interface of the holster spacer 806, and further extends through the sensor 836 as shown. Rather, the axis of elongation E is angled to approach the second axis B in a direction from the second end having the third aperture 722C toward the first end having the first and second apertures 722A, 722B (i.e., an upward direction as illustrated). The sensor 836 is a mechanical switch as shown, but other alternatives are optional as disclosed herein. The angle of skew between the second axis B and the axis of elongation E can be less than 15 degrees and may be configured to match the contour of a designated holster (not shown).

FIGS. 38 through 42 illustrate a holster spacer 906 according to another embodiment. Although not shown, it will be understood that the holster spacer 906 may be provided between a wearable component and a holster as part of a holster assembly similar to the holster assembly 100 as shown in FIG. 1. It is also noted that reference numbers for similar features and elements are kept in order, similar to those of FIGS. 1 through 3, but incremented by 800. The description of the holster spacer 906 of FIGS. 38 through 42 focuses primarily on the features that are unique from the holster spacers 106, 206, 306, 406, 506, 606, 706, 806 of FIGS. 1 through 3, FIGS. 4 through 13, FIGS. 14 through 30, FIG. 31, FIGS. 32 through 33, FIGS. 34 through 35, FIG. 36, and FIG. 37, respectively, with the understanding that the holster spacer 906 can include any and all of the features disclosed above with reference to the holster spacers 106, 206, 306, 406, 506, 606, 706, 806, except where expressly prohibited.

Figure 42:
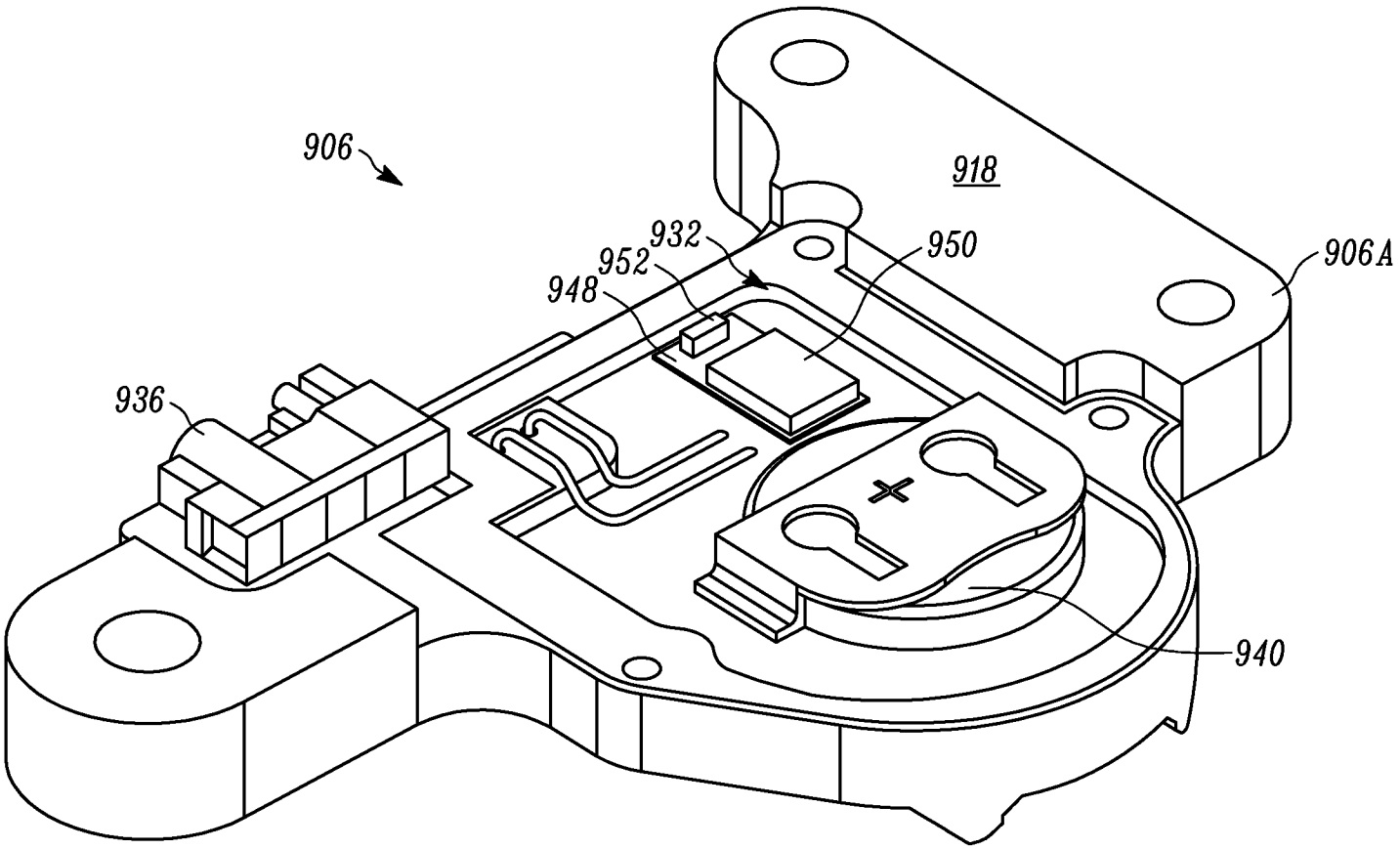
FIG. 42 is a perspective view illustrating the internals of the holster spacer of FIG. 38.

The holster spacer 906 includes a sensor 936 that has a sensing portion located on the same side as the second housing portion 906B that is the smaller housing portion covering the electronic circuitry. Although not shown behind the cover 966, a switch 964 is operable to selectively establish and break power supply to the electronic circuitry from the power source 940. The first housing portion 906A is shaped to include a sensor cavity 976 (FIG. 41) adjacent to the internal cavity 932 provided for the electronic circuitry. An access hole 977 is provided through the first housing portion 906 to provide for passing wiring between the sensor cavity 976 and the internal cavity 932 and also providing a point of exterior access for manipulating the wires during assembly. For example, the access hole 977 may be used to engage the wires and pass them from a first side of the printed circuit board assembly 948 to a second side of the printed circuit board assembly 948 where they are attached thereto as shown in FIG. 42. An additional access hole cover 978 is provided to enclose the access hole 977 during use.

FIGS. 43 through 50 illustrate a holster spacer 1006 and a holster assembly according to another embodiment. It is noted that reference numbers for similar features and elements are kept in order, similar to those of FIGS. 1 through 3, but incremented by 900. The description of the holster spacer 1006 of FIGS. 43 through 50 focuses primarily on the features that are unique from the holster spacers 106, 206, 306, 406, 506, 606, 706, 806, 906 of FIGS. 1 through 3, FIGS. 4 through 13, FIGS. 14 through 30, FIG. 31, FIGS. 32 through 33, FIGS. 34 through 35, FIG. 36, FIG. 37, and FIGS. 38 through 42, respectively, with the understanding that the holster spacer 1006 can include any and all of the features disclosed above with reference to the holster spacers 106, 206, 306, 406, 506, 606, 706, 806, 906, except where expressly prohibited.

The holster assembly 1000 includes a wearable component 1002 and a holster 1004, which as illustrated, is designed for a conducted electrical weapon 1012 having a grip and a barrel. As with some of the other holster spacers disclosed herein, the internal cavity 1032 housing the electronic circuitry is positioned generally away from the mounting interface and outside the imaginary envelope area 1056 to avoid interference with the engagement between the holster 1004 and the wearable component 1002. The holster spacer 1006 also includes a separate sensor cavity 1076 (FIGS. 47, 49 and 50) spaced away from the mounting interface and outside the imaginary envelope area 1056 on an opposite side from the internal cavity 1032. The sensor cavity 1076 is located in an area of the first housing portion 1006A that is extended in a direction substantially away from, in particular perpendicular from, a plane defined by the holster spacer 1006 within the mounting interface. As such, a wraparound switch housing is formed by this arrangement.

Figure 44:
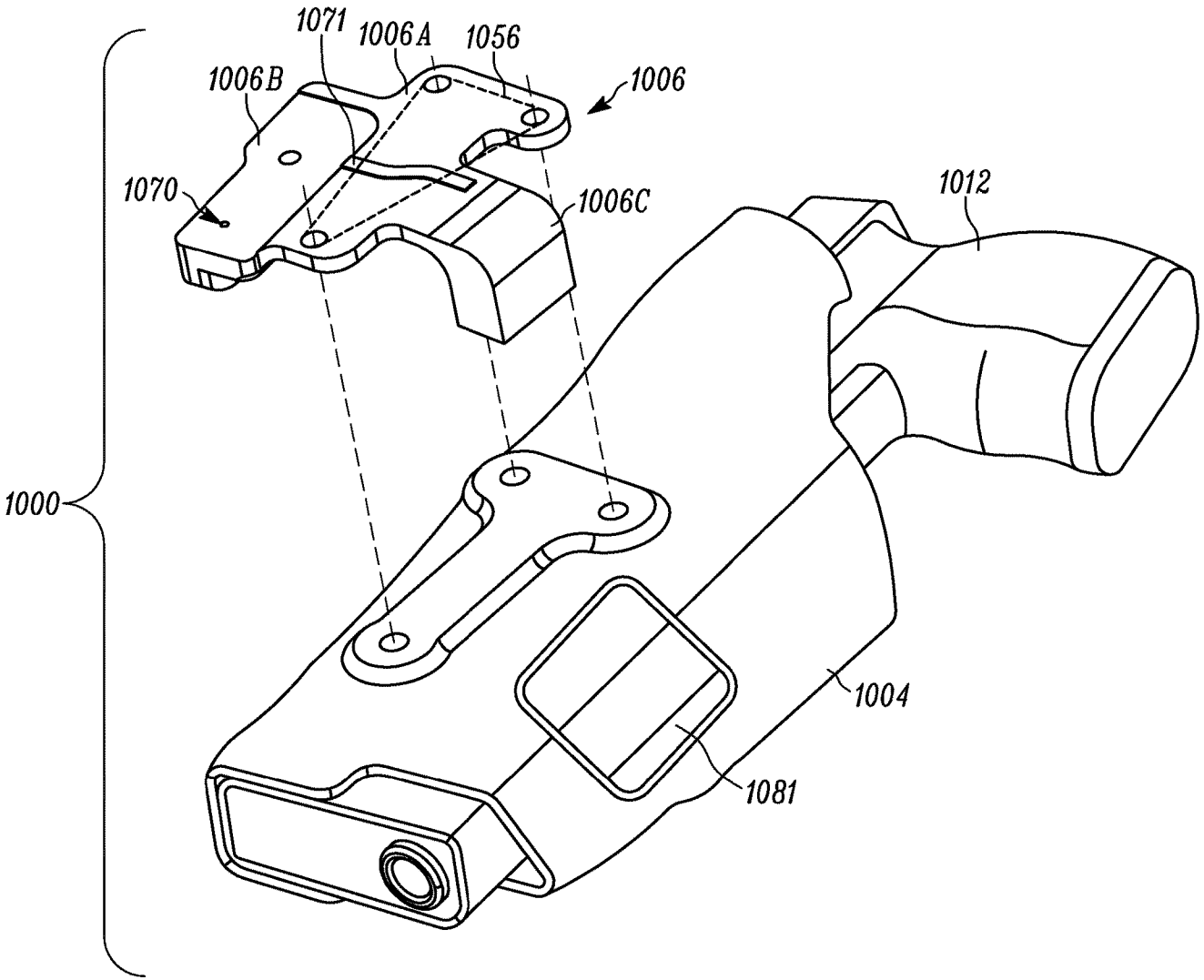
FIG. 44 is an exploded view of the holster assembly of FIG. 43.
Figure 45:
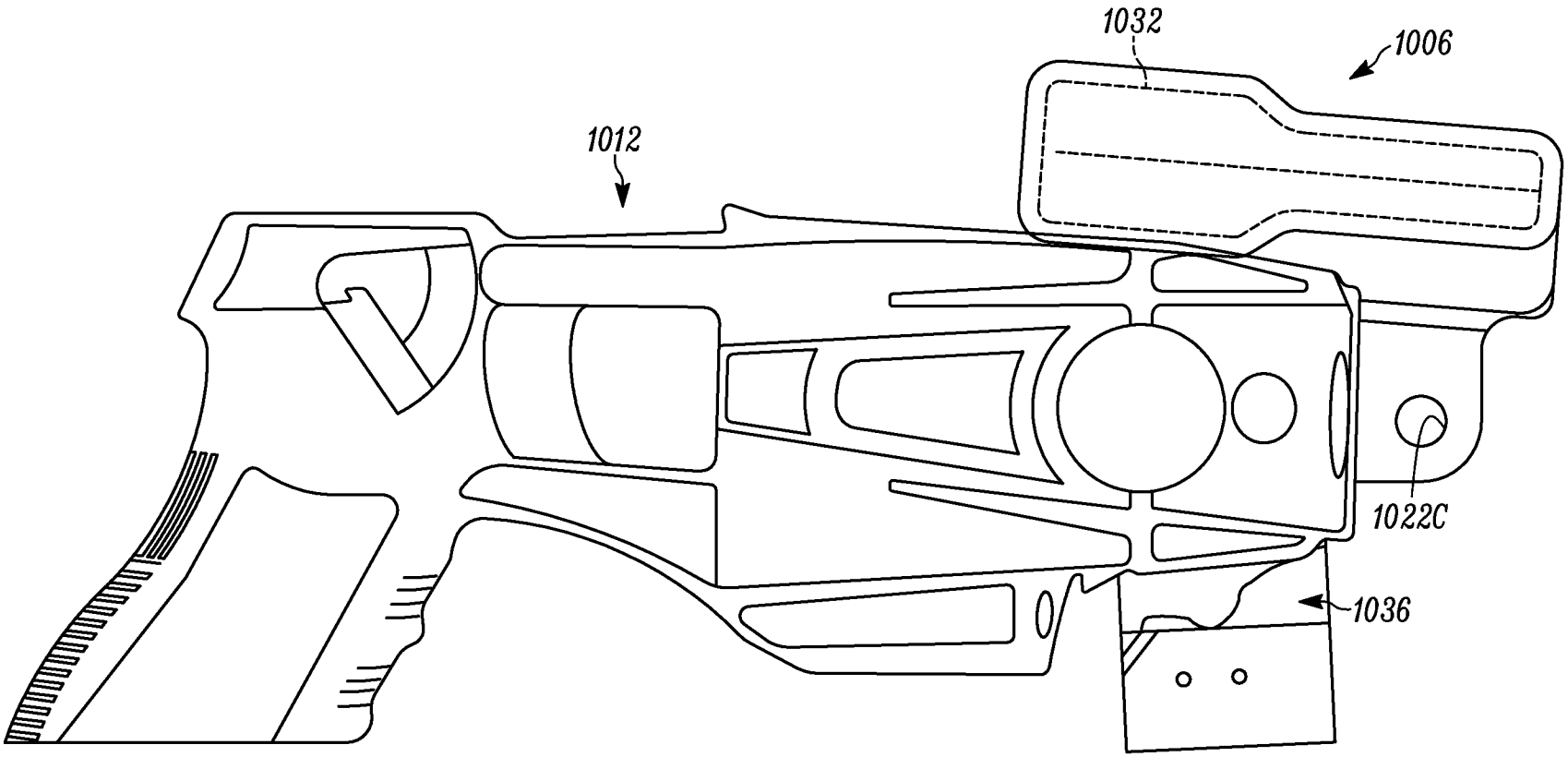
FIG. 45 is a front view of the holster assembly of FIG. 43, with the holster removed to illustrate the interface between the weapon and a sensor of the holster spacer.
Figure 47:
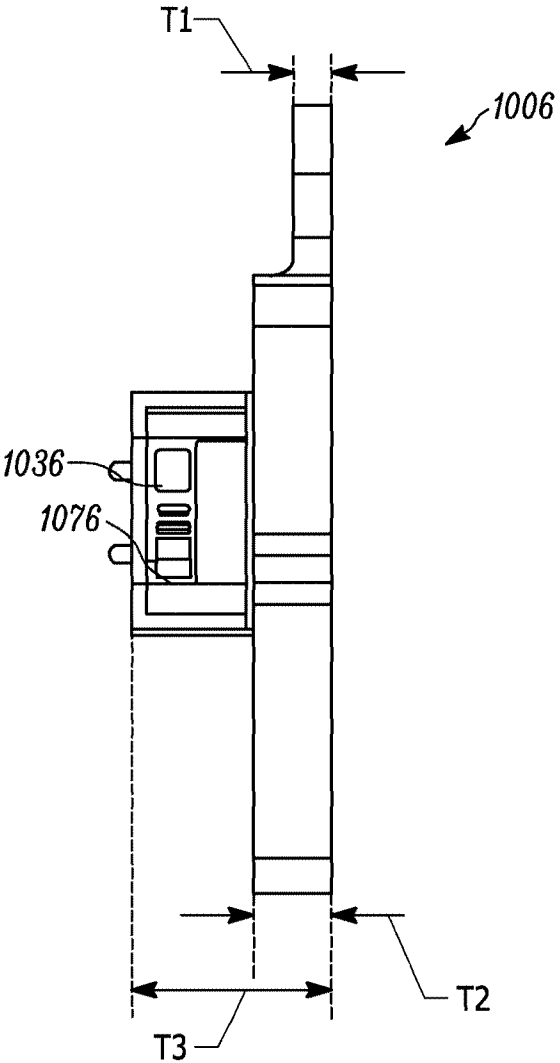
FIG. 47 is a left side view of the holster spacer of FIG. 43.
Figure 46:
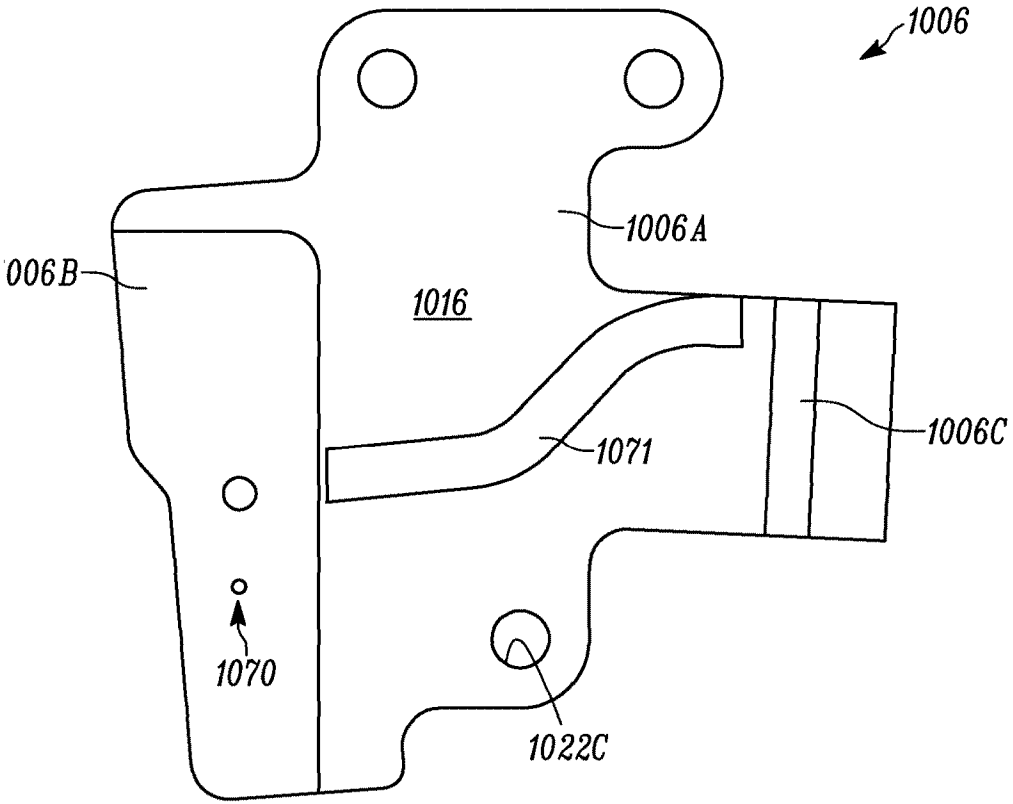
FIG. 46 is a rear view of the holster spacer of FIG. 43.
Figure 49:
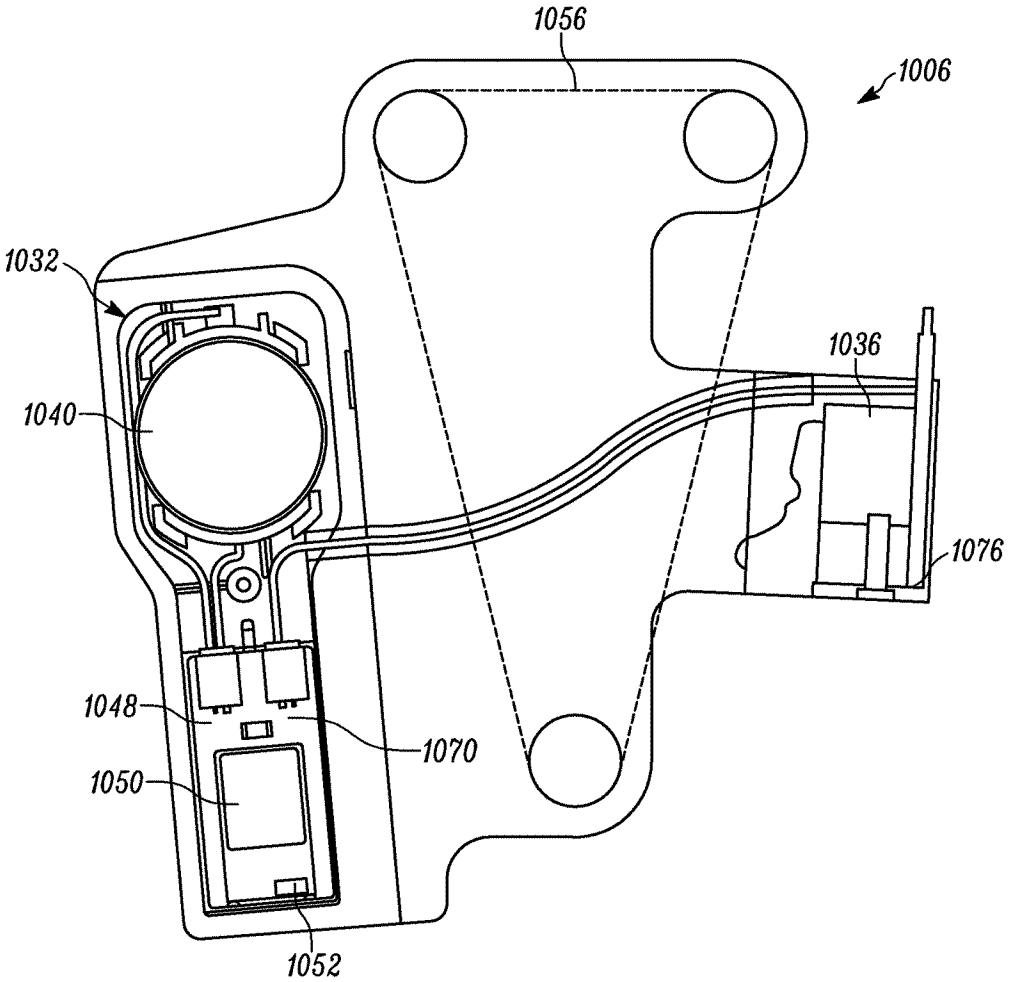
FIG. 49 is a rear view of the internals of the holster spacer of FIG. 43.
Figure 48:
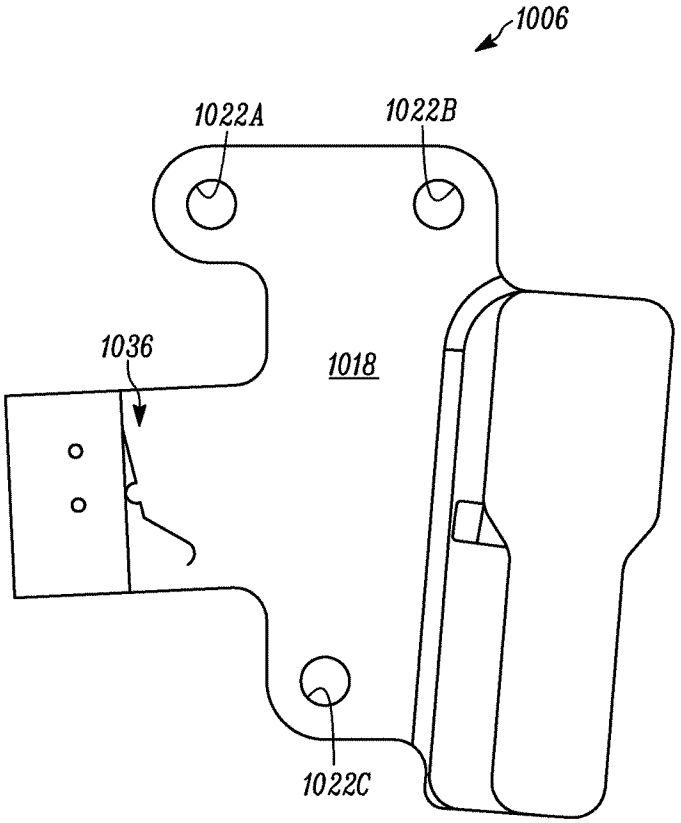
FIG. 48 is a front view of the holster spacer of FIG. 43.
Figure 50:
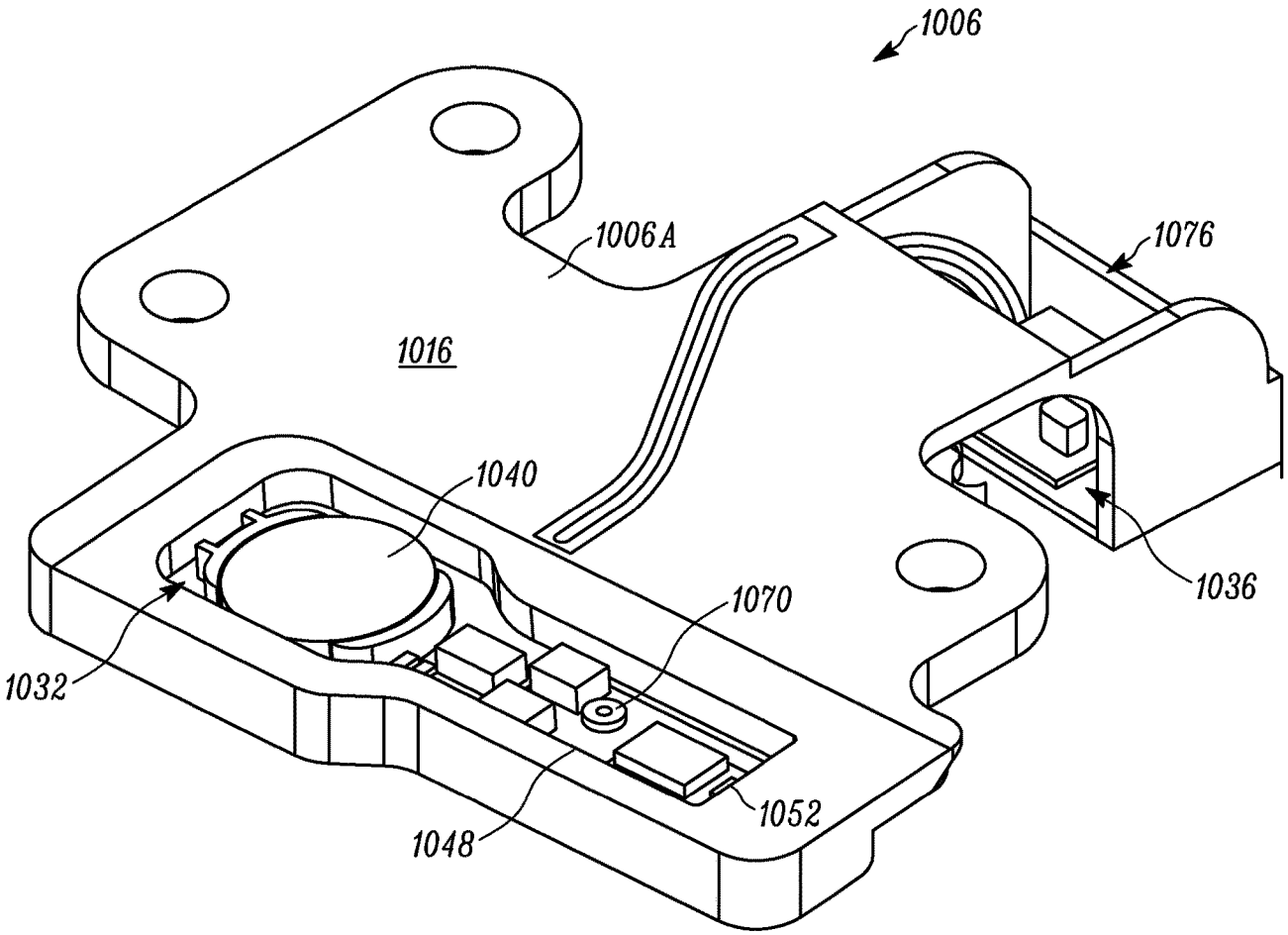
FIG. 50 is a perspective view of the internals of the holster spacer of FIG. 43.
Figure 52:
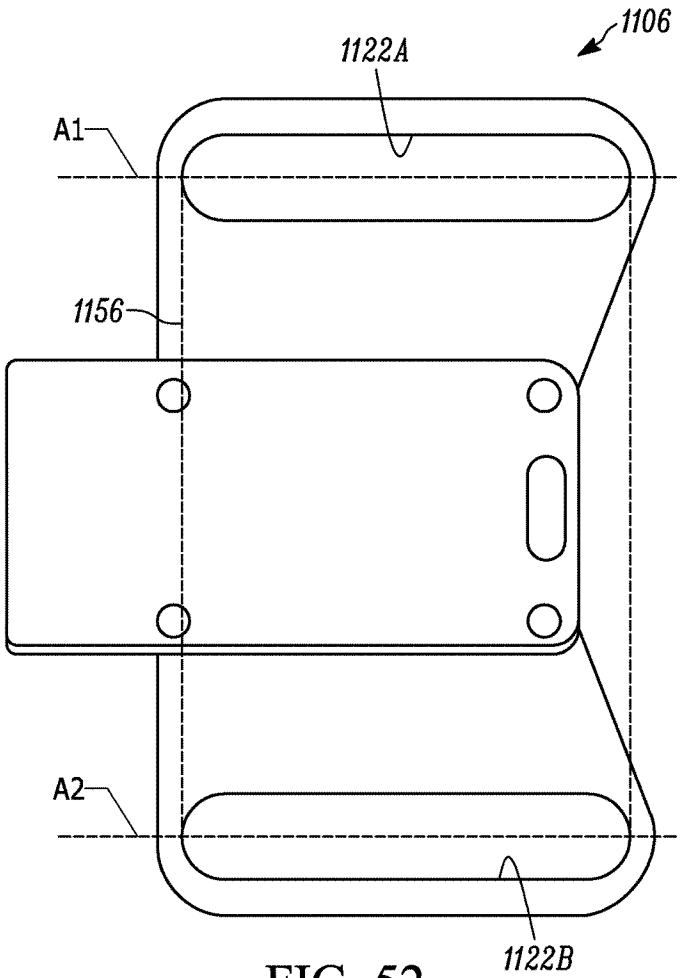
FIG. 52 is a front view of the holster spacer of FIG. 51.
Figure 51:
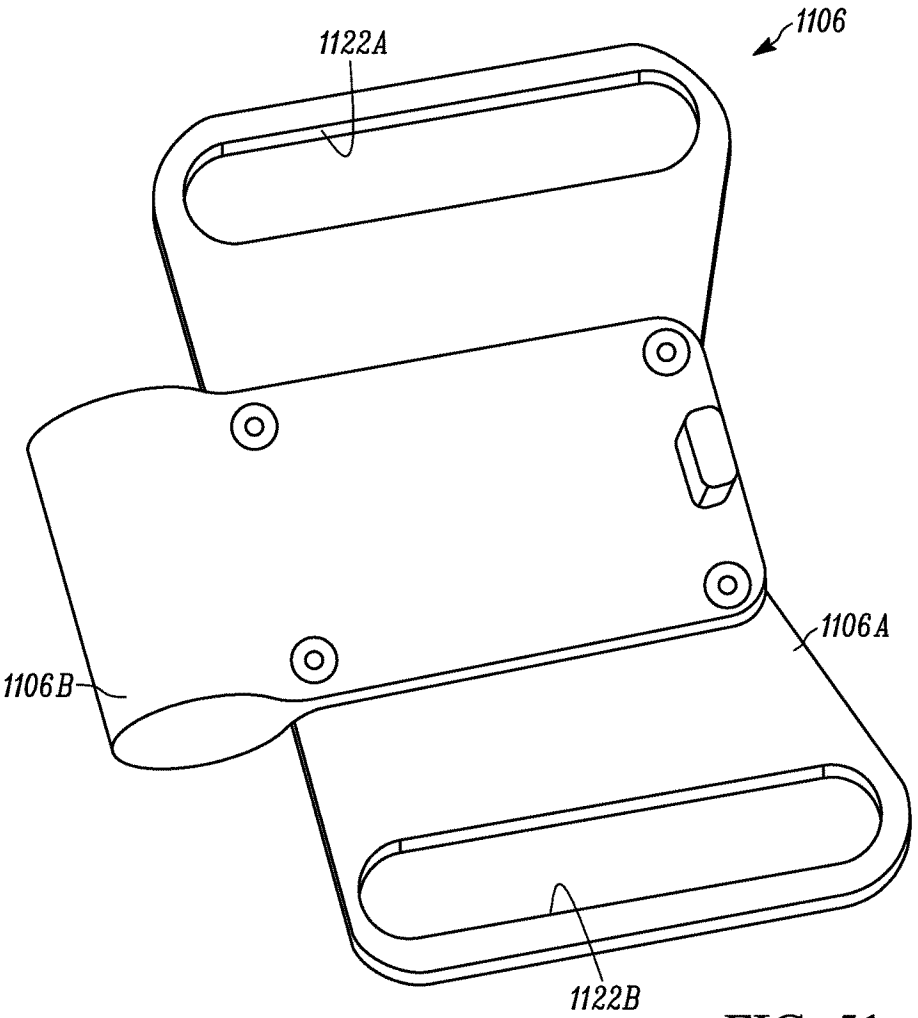
FIG. 51 is a perspective view of a holster spacer in accordance with some embodiments.
Figure 53:
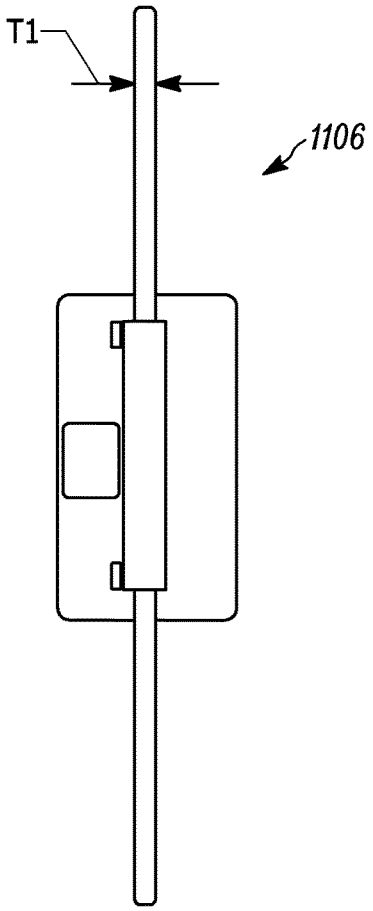
FIG. 53 is a right side view of the holster spacer of FIG. 51.
Figure 54:
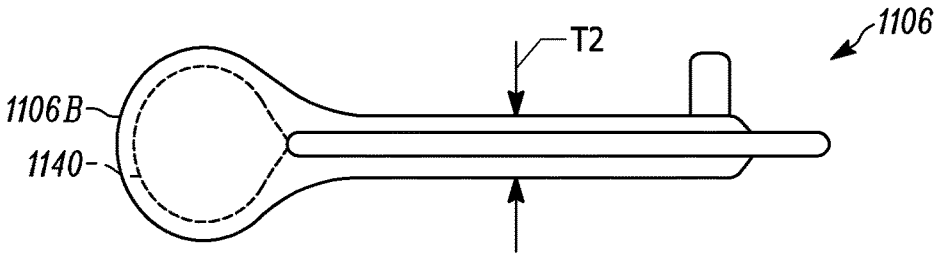
FIG. 54 is a bottom view of the holster spacer of FIG. 51.
Figure 56:
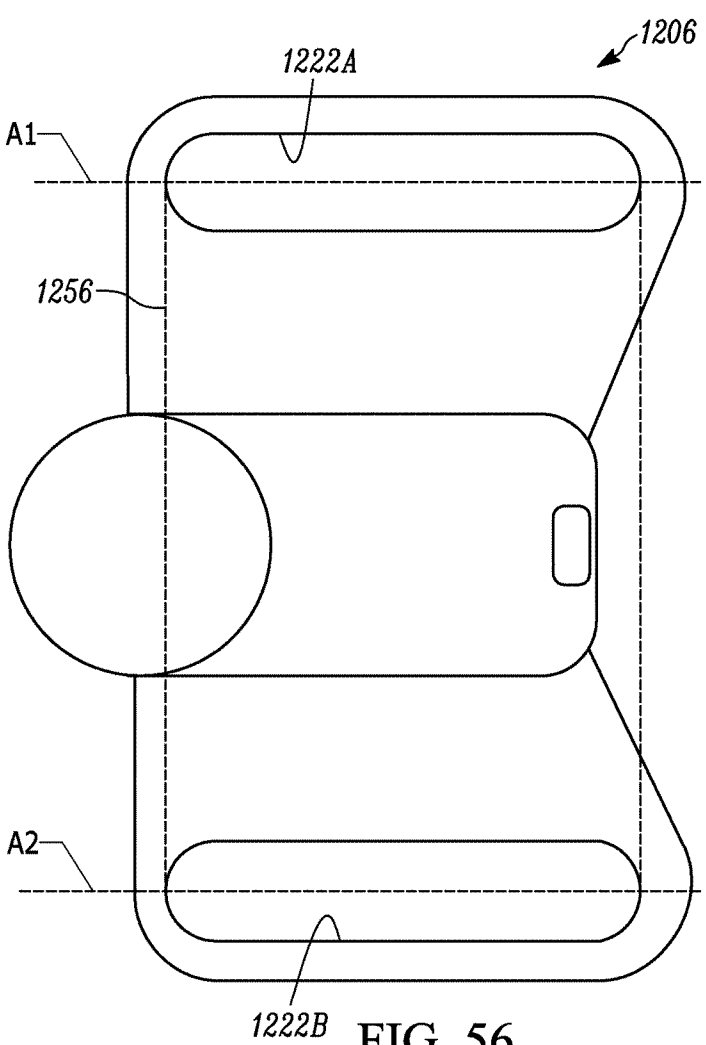
FIG. 56 is a front view of the holster spacer of FIG. 55.
Figure 55:
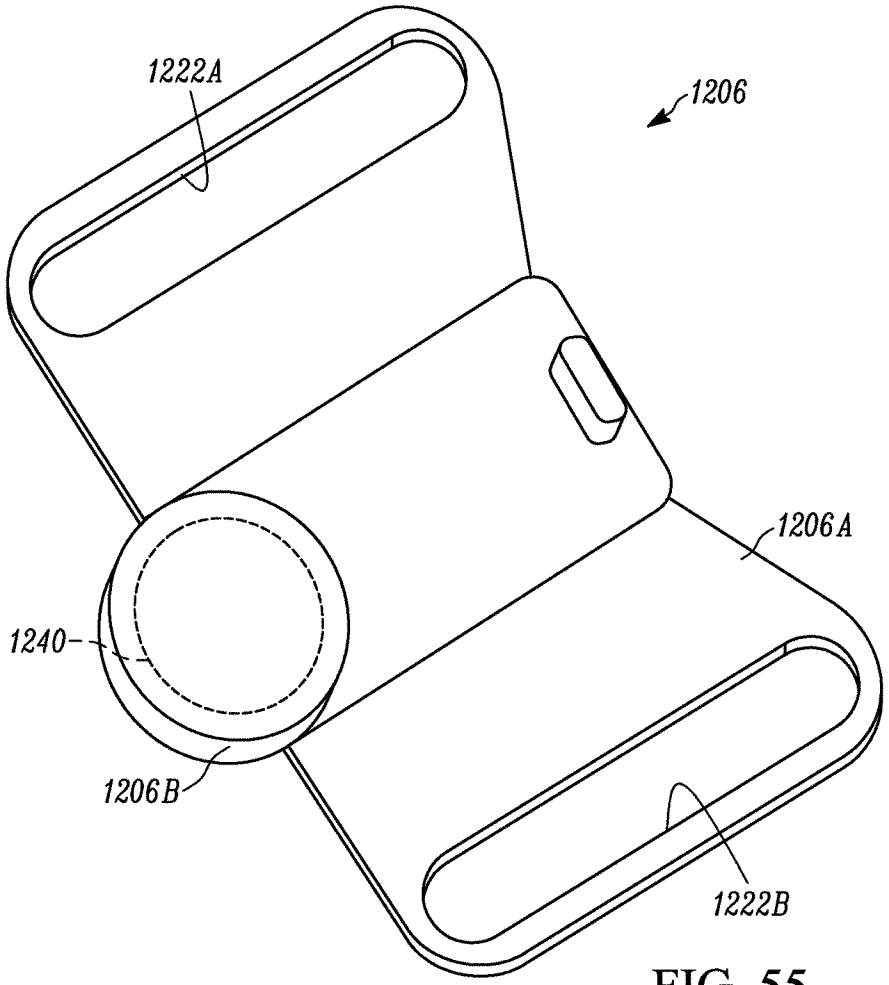
FIG. 55 is a perspective view of a holster spacer in accordance with some embodiments.
Figure 57:
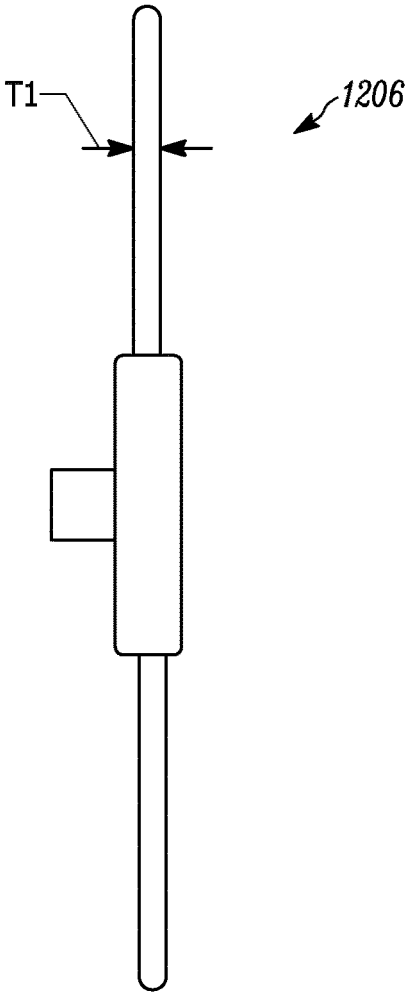
FIG. 57 is a right side view of the holster spacer of FIG. 55.
Figure 58:
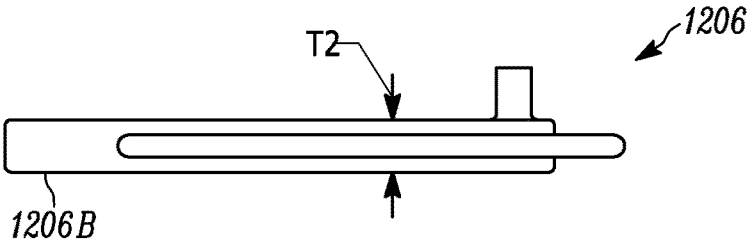
FIG. 58 is a bottom view of the holster spacer of FIG. 55.

Furthermore, as shown in FIG. 45, the sensor 1036 is configured to interface with the conducted electrical weapon 1012 on an underside of a barrel rather than on a side of the conducted electrical weapon 1012 facing toward the wearable component 1002 or toward the user when worn. FIG. 44 illustrates a sensor aperture 1081 formed in a side wall of the holster 1004 for partially or fully receiving the sensor 1036. The sensor aperture 1081 can provide direct physical contact between a portion of the sensor 1036 (e.g., a mechanical switch actuator) and the conducted electrical weapon 1012. An additional housing portion 1006C can be provided to enclose the sensor 1036 within the sensor cavity 1076. A separate wiring cover 1071 can be provided to enclose the sensor wiring within a wiring channel in the first housing portion 1006A.

Unlike the wearable component 102 depicted in earlier drawings, the wearable component 1002 is a clamp-type adapter that does not include slits requiring passage of a belt. Rather, in the form of the clamp-type adapter, the wearable component 1002 includes two portions or halves that are pivotally coupled and biased together (e.g., by a spring, not shown). The clamp-type adapter may optionally include a positive locking device to securely maintain a closed position in addition to a simple biasing force toward the closed position. As a clamp-type adapter, the holster assembly 1000 may be more quickly put into use on a wearer's belt or clothing or removed therefrom.

FIGS. 51 through 54 illustrate a holster spacer 1106 according to another embodiment. Although not shown, it will be understood that the holster spacer 1106 may be provided between a wearable component and a holster as part of a holster assembly similar to the holster assembly 100 as shown in FIG. 1. It is also noted that reference numbers for similar features and elements are kept in order, similar to those of FIGS. 1 through 3, but incremented by 1000. The description of the holster spacer 1106 of FIGS. 51 through 54 focuses primarily on the features that are unique from the holster spacers 106, 206, 306, 406, 506, 606, 706, 806, 906, 1006 of FIGS. 1 through 3, FIGS. 4 through 13, FIGS. 14 through 30, FIG. 31, FIGS. 32 through 33, FIGS. 34 through 35, FIG. 36, FIG. 37, FIGS. 38 through 42, and FIGS. 43 through 50, respectively, with the understanding that the holster spacer 1106 can include any and all of the features disclosed above with reference to the holster spacers 106, 206, 306, 406, 506, 606, 706, 806, 906, 1006 except where expressly prohibited.

The holster spacer 1106 includes a mounting interface which differs from those disclosed in the foregoing figures. The mounting interface includes at least one aperture, however, the apertures are not circular as in the earlier embodiments, and are not provided in a T-shape. Rather, a first aperture 1122A in the form of an elongated slot is formed at a first (e.g., upper) end of the holster spacer 1106 and a second aperture 1122B in the form of an elongated slot is formed at a second (e.g., lower) end of the holster spacer 1106. As shown, each aperture 1122A, 1122B defines a corresponding elongation axis A1, A2. In the illustrated construction, the elongation axes A1, A2 are parallel, although other orientations are possible, including arcuate slots and/or the use of one or more slots with one or more circular apertures to form a mounting interface. By using elongated slots, it may be possible to manufacture the holster spacer 1106 with the capability of use in a wider variety of different holster assemblies, including holsters and/or wearable components of various different manufacturers, having different mounting interfaces.

The first housing portion 1106A of the holster spacer 1106 defines an outer perimeter within which the first and second apertures 1122A, 1122B are provided. An imaginary envelope area 1156 is also defined by the apertures 1122A, 1122B in accordance with the foregoing description. Although not shown, electronic circuitry in accordance with any of the above embodiments may be provided within the outer perimeter and within the imaginary envelope area 1156. However, a power source 1140 may be located partially or entirely outside of the imaginary envelope area 1156 and/or the outer perimeter. As illustrated, the power source 1140 includes a cylindrical-shaped primary cell battery received within a housing portion that is entirely outside the imaginary envelope area 1156 and the outer perimeter defined by the first housing portion 1106A. Thus, excessive thickness in the area of the mounting interface can be avoided. The second housing portion 1106B may be removably coupled to the first housing portion 1106A to enclose the power source 1140 and to allow replacement thereof. In the illustrated arrangement, the second housing portion 1106B containing the power source 1140 is free or exposed on five of its six sides. As such, the power source 1140 does not contribute to a first thickness T1 in a first area within the imaginary envelope area 1156, or a second thickness T2 in a second area within the imaginary envelope area 1156 of the holster spacer 1106.

FIGS. 55 through 58 illustrate a holster spacer 1206 according to another embodiment. Although not shown, it will be understood that the holster spacer 1206 may be provided between a wearable component and a holster as part of a holster assembly similar to the holster assembly 100 as shown in FIG. 1. It is also noted that reference numbers for similar features and elements are kept in order, similar to those of FIGS. 1 through 3, but incremented by 1100. The description of the holster spacer 1206 of FIGS. 55 through 59 focuses primarily on the features that are unique from the holster spacers 106, 206, 306, 406, 506, 606, 706, 806, 906, 1006, 1106 of FIGS. 1 through 3, FIGS. 4 through 13, FIGS. 14 through 30, FIG. 31, FIGS. 32 through 33, FIGS. 34 through 35, FIG. 36, FIG. 37, FIGS. 38 through 42, FIGS. 43 through 50, and FIGS. 51 through 54, respectively, with the understanding that the holster spacer 1206 can include any and all of the features disclosed above with reference to the holster spacers 106, 206, 306, 406, 506, 606, 706, 806, 906, 1006, 1106, except where expressly prohibited.

The holster spacer 1206 includes a mounting interface as described above with reference to the holster spacer 1106, but which differs from those disclosed in the other foregoing figures. In summary, rather than three circular apertures in a T-shaped pattern, first and second apertures 1222A, 1222B are provided in the form of elongated slots defining corresponding elongation axes A1, A2. Potential advantages and variations of this arrangement are as described above.

Although not shown, electronic circuitry in accordance with any of the above embodiments may be provided within an outer perimeter defined by a first housing portion 1206A and within an imaginary envelope area 1256 defined by the first and second apertures 1222A, 1222B. However, a power source 1240 may be located partially or entirely outside of the imaginary envelope area 1256 and/or the outer perimeter. As illustrated, the power source 1240 includes a disk-shaped coin cell or button cell battery received within a housing portion 1206B that is partially outside the imaginary envelope area 1256 and the outer perimeter defined by the first housing portion 1206A. The second housing portion 1206B may be integrally provided or permanently coupled to the first housing portion 1206A to enclose the power source 1240 and the holster spacer 1206 may be designed for disposal or recycling after use. In other constructions, the housing portions 1206A, 1206B are detachable for periodic replacement of the power source 1240. In the illustrated arrangement, the second housing portion 1206B containing the power source 1240 is free or exposed on five of its six sides. Although the excess thickness is small, the power source 1240 does not contribute to a first thickness T1 in a first area within the imaginary envelope area 1256, or a second thickness T2 in a second area within the imaginary envelope area 1256 of the holster spacer 1206.

Figure 60:
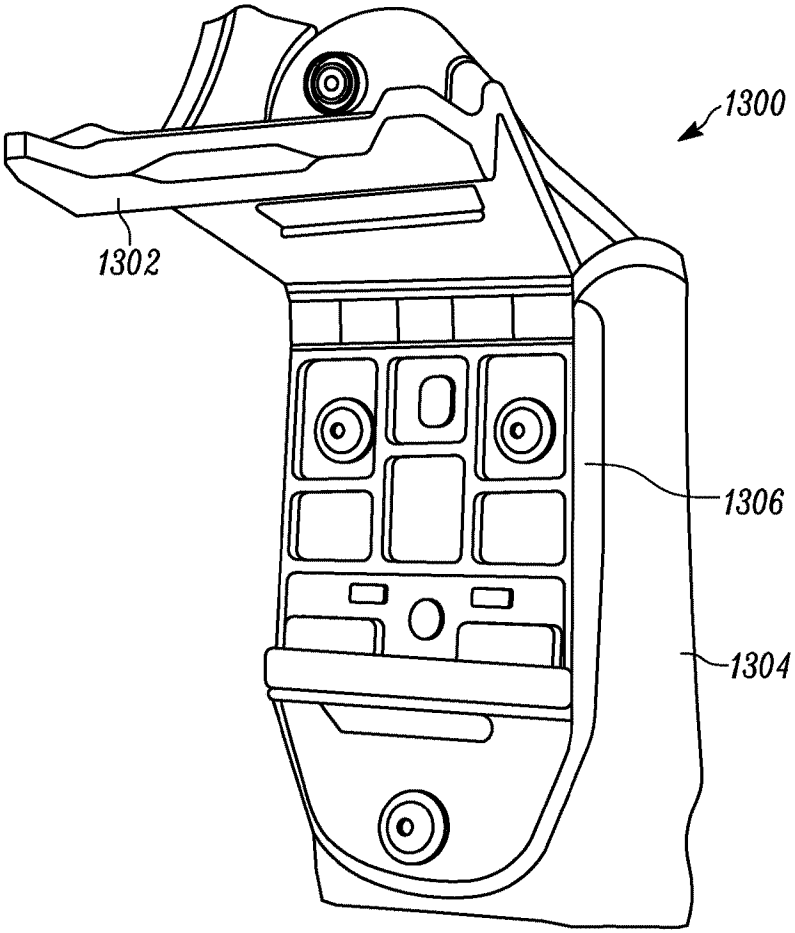
FIG. 60 is a second perspective view of the holster assembly of FIG. 59.
Figure 59:
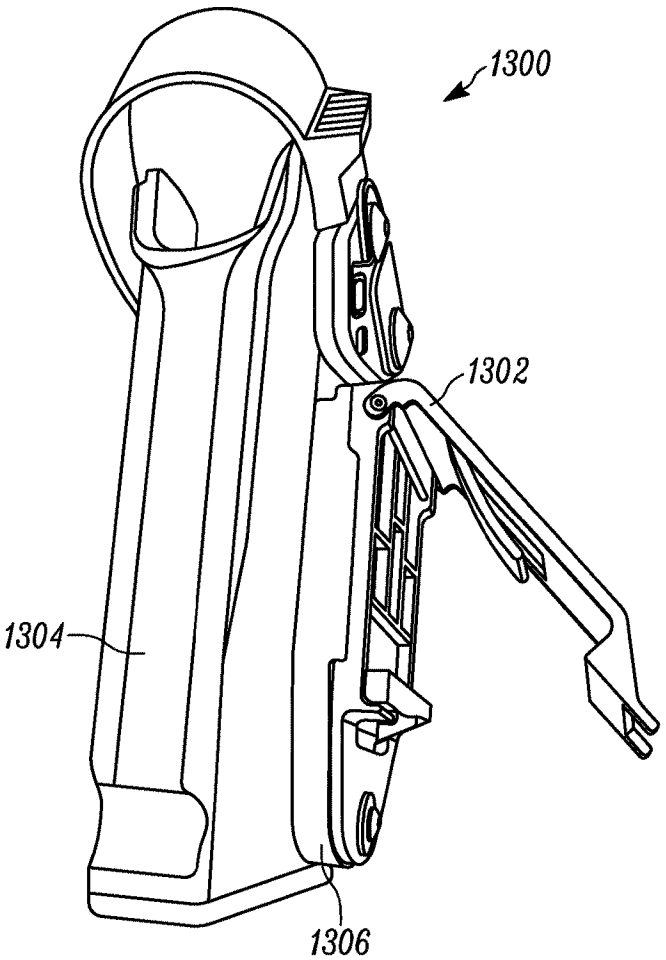
FIG. 59 is a first perspective view of a holster assembly in accordance with some embodiments.
Figure 61:
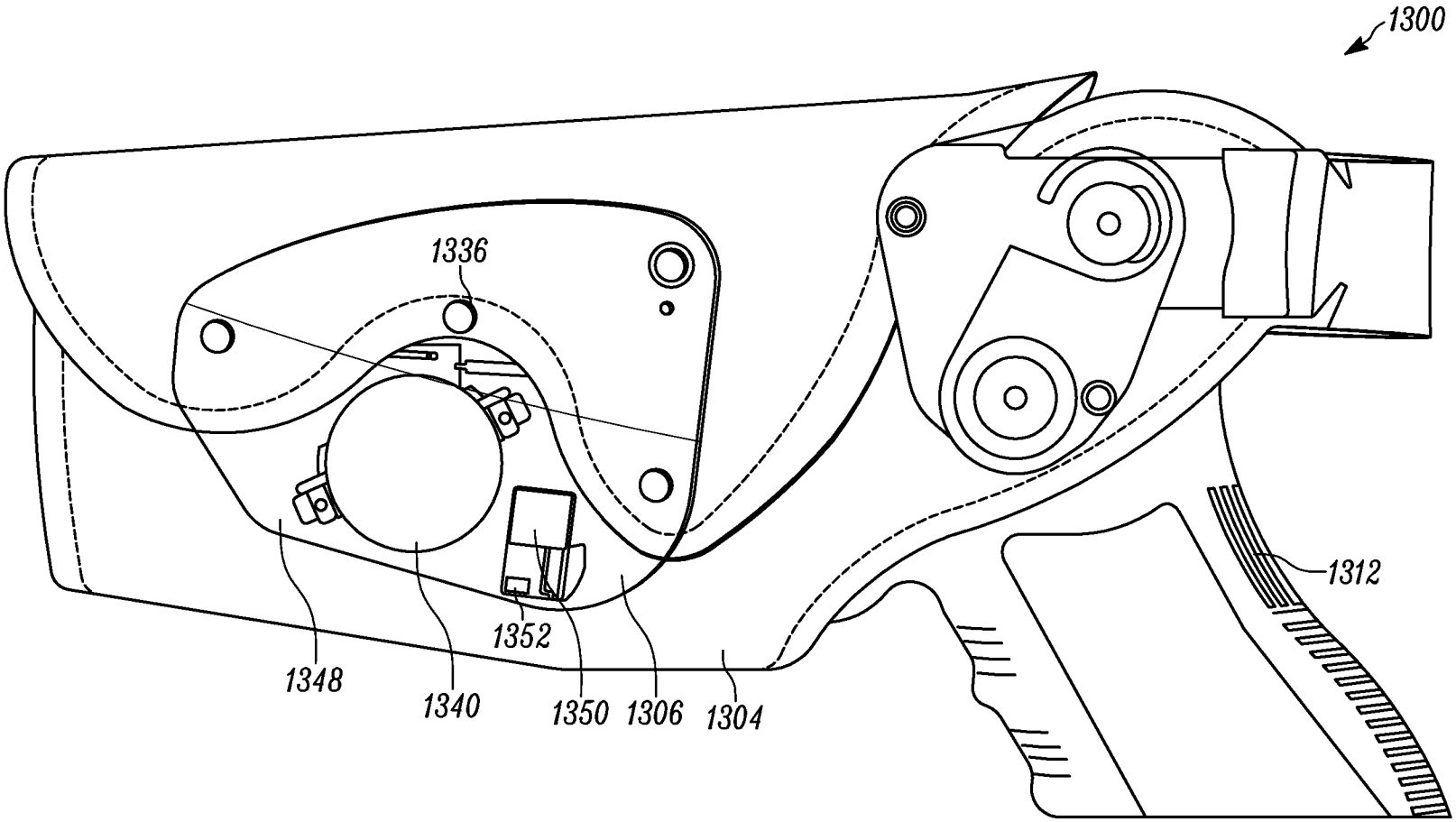
FIG. 61 is a front view of the holster assembly of FIG. 59, shown with a holstered weapon and a wearable component removed.

FIGS. 59 through 61 illustrate a holster spacer 1306 and a holster assembly 1300 according to another embodiment. It is noted that reference numbers for similar features and elements are kept in order, similar to those of FIGS. 1 through 3, but incremented by 1100. The description of the holster spacer 1306 of FIGS. 60 and 61 focuses primarily on the features that are unique from the holster spacers 106, 206, 306, 406, 506, 606, 706, 806, 906, 1006, 1106, 1206 of FIGS. 1 through 3, FIGS. 4 through 13, FIGS. 14 through 30, FIG. 31, FIGS. 32 through 33, FIGS. 34 through 35, FIG. 36, FIG. 37, FIGS. 38 through 42, FIGS. 43-50, FIGS. 51 through 54, and FIGS. 55 through 58, respectively, with the understanding that the holster spacer 1306 can include any and all of the features disclosed above with reference to the holster spacers 106, 206, 306, 406, 506, 606, 706, 806, 906, 1006, 1106, 1206, except where expressly prohibited.

Figure 43:
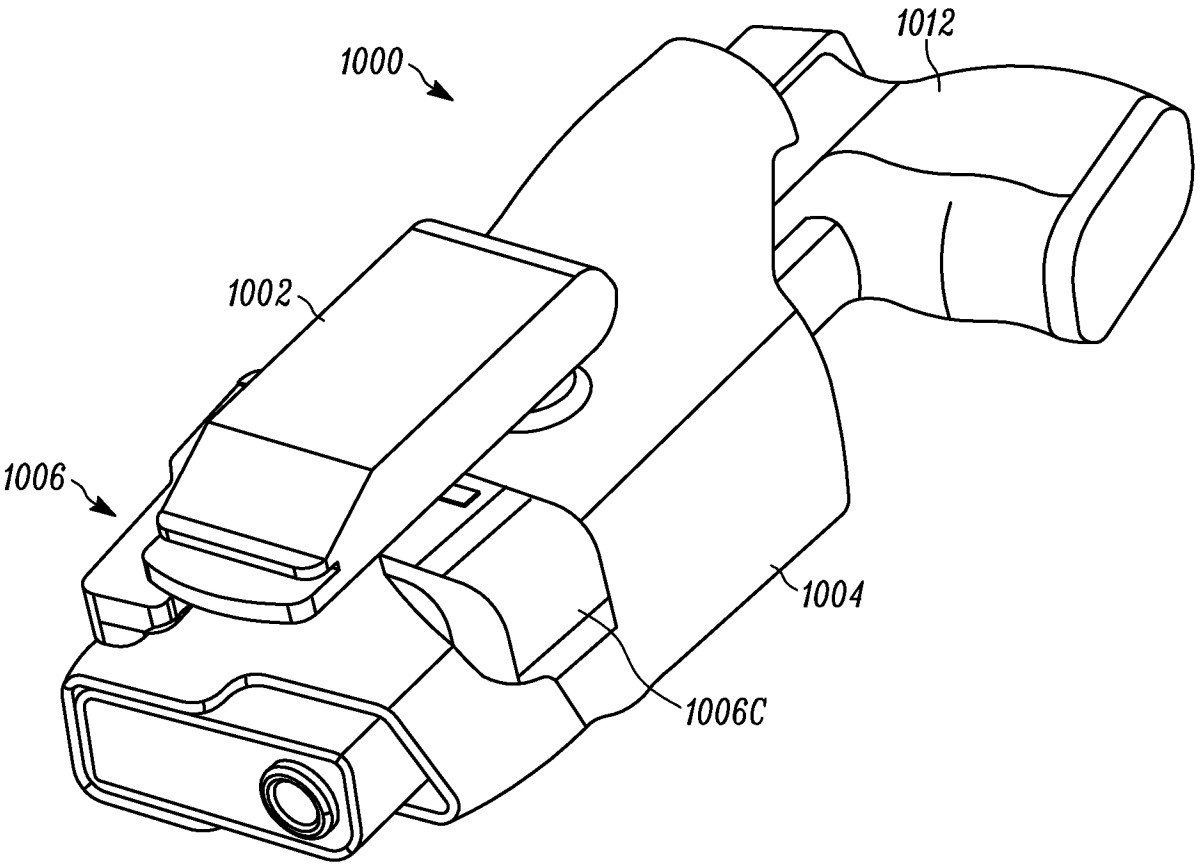
FIG. 43 is a perspective view of a holster assembly in accordance with some embodiments.

Similar to that of FIG. 43, the wearable component 1302 can be a clamp-type adapter, and the above description is hereby referenced. The wearable component 1302 is shown in an open configuration in FIGS. 59 and 60. FIG. 61 illustrates the layout of the sensor 1336 and the corresponding electronic circuitry on the holster spacer 1306 in use with the holster 1304 having a pistol 1312 therein. The electronic circuitry can be positioned near a side edge of the holster spacer 1306 in order to provide convenient access to any one or more of: the power source 1340, the communication module 1350, and a user interface including for example, a power switch, or an indicator light. All or substantially all of the area of the holster spacer 1306 may be occupied by the printed circuit board assembly 1348 such that the first, second, and third apertures 1322A, 1322B, 1322C are provided directly in a substrate of the printed circuit board assembly 1348.

Although each of the illustrated embodiments show electronic circuitry including a processor located within the holster spacer, it is noted that any of the illustrated embodiments may be modified to locate a sensor on-board the holster spacer with substantially no additional electronic components, whereby the sensor signal is received and processed by one or more circuits located remotely from the holster spacer.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A holster spacer adaptable for use within a holster assembly including a wearable component and a separable holster supported by the wearable component, the holster spacer comprising:

a wearable component-facing surface;

a holster-facing surface opposite the wearable component-facing surface;

a mounting interface for securing the holster spacer between the wearable component and the holster, wherein the mounting interface includes one or more apertures;

an internal cavity provided between the wearable component-facing surface and the holster-facing surface; and a sensor positioned in the internal cavity and operable to detect a parameter relating to an implement positionable within the holster, wherein the sensor includes an inductive sensing element.

2. The holster spacer of claim 1, wherein the one or more apertures includes first and second apertures provided adjacent a first end of the holster spacer and a third aperture provided adjacent a second end of the holster spacer, wherein the first and second apertures are spaced apart from each other along a first axis, and the third aperture is equally spaced from each of the first and second apertures along a second axis that bisects the first axis.

3. The holster spacer of claim 2, wherein a first spacing distance between the first and second apertures along the first axis is less than a second spacing distance from the third aperture to the first and second apertures.

4. The holster spacer of claim 2, wherein the sensor is located within an imaginary envelope area defined by connecting the first, second, and third apertures.

5. The holster spacer of claim 2, wherein the sensor is located outside of an imaginary envelope area defined by connecting the first, second, and third apertures.

6. The holster spacer of claim 1, wherein the sensor is a presence sensor operable to detect whether or not the implement is positioned within the holster and further operable to output a position notification signal.

7. The holster spacer of claim 1, wherein the sensor is a proximity sensor operable to detect a proximity of the implement with respect to the proximity sensor and further operable to output a proximity notification signal.

8. The holster spacer of claim 1, further comprising electronic circuitry provided within the internal cavity, the electronic circuitry for processing an output of the sensor.

9. The holster spacer of claim 8, wherein the electronic circuitry further includes a transceiver operable to receive the output of the sensor and further operable to transmit a wireless signal indicative thereof to a remote device.

10. The holster spacer of claim 8, wherein the electronic circuitry includes a power source comprising one or more of the following: a primary battery, a rechargeable battery, a supercapacitor, and an energy harvesting circuit.

11. The holster spacer of claim 8, wherein the electronic circuitry includes a wireless charging circuit.

12. The holster spacer of claim 1, further comprising a user interface including any one or more of the following: an indicator light, a piezo buzzer, a speaker, a vibrator, and a haptic micro-electric-mechanical device.

13. A holster assembly comprising:

a holster defining a receiving area for an implement; and a holster spacer positioned alongside the holster and having a thickness configured to increase a spacing distance between a wearer of the holster and a surface of the holster configured to face towards the wearer, wherein the holster spacer includes a mounting interface with one or more apertures, wherein the holster spacer includes a sensor operable to detect a parameter relating to the implement positionable within the receiving area of the holster, wherein the sensor includes an inductive sensing element.

14. The holster assembly of claim 13, wherein the one or more apertures includes first and second apertures provided adjacent a first end of the holster spacer and a third aperture provided adjacent a second end of the holster spacer, wherein the first and second apertures are spaced apart from each other along a first axis, and the third aperture is equally spaced from each of the first and second apertures along a second axis that bisects the first axis.

15. The holster assembly of claim 14, wherein a first spacing distance between the first and second apertures along the first axis is less than a second spacing distance from the third aperture to the first and second apertures.

16. The holster assembly of claim 14, wherein the sensor is located within an imaginary envelope area defined by connecting the first, second, and third apertures.

17. The holster assembly of claim 14, wherein the sensor is located outside of an imaginary envelope area defined by connecting the first, second, and third apertures.

18. The holster assembly of claim 13, wherein the holster spacer includes an internal cavity, and electronic circuitry within the internal cavity, the electronic circuitry for processing an output of the sensor.

19. The holster assembly of claim 18, wherein the sensor is a presence sensor operable to detect whether or not the implement is positioned within the holster and further operable to output a presence notification signal.

20. The holster assembly of claim 18, wherein the sensor is a proximity sensor operable to detect a proximity of the implement with respect to the proximity sensor and further operable to output a proximity notification signal.

21. The holster assembly of claim 18, wherein the electronic circuitry includes a transceiver operable to receive the output of the sensor and further operable to transmit a wireless signal indicative thereof to a remote device.

22. The holster assembly of claim 18, wherein the electronic circuitry includes a power source comprising one or more of the following: a primary battery, a rechargeable battery, a supercapacitor, and an energy harvesting circuit.

23. The holster assembly of claim 18, wherein the electronic circuitry includes a wireless charging circuit.

24. The holster assembly of claim 13, further comprising a user interface including any one or more of the following: an indicator light, a piezo buzzer, a speaker, a vibrator, and a haptic micro-electric-mechanical device.

* * * * *